United States Patent [19]

Nishijima et al.

[11] Patent Number: 4,906,559

[45] Date of Patent: Mar. 6, 1990

[54] LIGHT-SENSITIVE SILVER HALIDE PHOTOGRAPHIC MATERIAL

[75] Inventors: Toyoki Nishijima; Kaoru Onodera, both of Odawara, Japan

[73] Assignee: Konishiroku Photo Industry Co., Ltd., Tokyo, Japan

[21] Appl. No.: 385,929

[22] Filed: Jul. 21, 1989

Related U.S. Application Data

[63] Continuation of Ser. No. 154,516, Feb. 4, 1988, abandoned, which is a continuation of Ser. No. 828,151, Feb. 10, 1986, abandoned.

[30] Foreign Application Priority Data

Feb. 22, 1985 [JP] Japan ..... 60-34892

[51] Int. Cl.[4] ..... G03C 7/38; G03C 7/26

[52] U.S. Cl. ..... 430/551; 430/558

[58] Field of Search ..... 430/551, 372, 558

[56] References Cited

U.S. PATENT DOCUMENTS

| | | | |
|---|---|---|---|
| 4,155,765 | 5/1979 | Fujiwhara et al. | 430/372 |
| 4,346,165 | 8/1982 | Sawade et al. | 430/372 |
| 4,385,111 | 5/1983 | Nakamura et al. | 430/551 |
| 4,588,679 | 5/1986 | Furutachi | 430/551 |
| 4,590,153 | 5/1986 | Kawagishi et al. | 430/551 |
| 4,622,287 | 11/1986 | Umemoto et al. | 430/505 |

*Primary Examiner*—Paul R. Michl
*Assistant Examiner*—Lee C. Wright
*Attorney, Agent, or Firm*—Frishauf, Holtz, Goodman & Woodward

[57] ABSTRACT

There is disclosed a light-sensitive silver halide photographic material which comprises a magenta coupler represented by the formula (I), a compound represented by the formula (XI), and further at least one compound selected from the group consisting of the compounds represented by the formulae (XII), (XIII) and (XIV):

(I)

wherein Z, X and R have the same meanings as defined in the specification, (XI)

wherein $R_{21}$ to $R_{25}$, A and X have the same meanings as defined in the specification, (XII)

(XIII)

(XIV)

wherein $R_{26}$ to $R_{45}$ and J have the same meanings as defined in the specification.

15 Claims, No Drawings

LIGHT-SENSITIVE SILVER HALIDE PHOTOGRAPHIC MATERIAL

This application is a continuation of application Ser. No. 07/154,156, filed Feb. 4, 1988, now abandoned, which is a continuation of Ser. No. 06/828,151, filed on Feb. 10, 1986, now abandoned.

BACKGROUND OF THE INVENTION

This invention relates to a light-sensitive silver halide photographic material with improved color reproducibility and increased resistance to color change or fading of a dye image due to light, heat or humidity.

As the method for forming a dye image using a light-sensitive color photographic material, there may be mentioned the method in which a dye is formed through the reaction between a coupler for photography and the oxidized product of a color developing agent. For the coupler for photography for effecting ordinary color reproduction, the respective couplers of magenta, yellow and cyan, while for the color developing agent, an aromatic primary amine type color developing agent, have been recommended. Through the reaction of the respective couplers of magenta and yellow with the oxidized product of an aromatic primary amine type color developing agent, dyes such as azomethyne dye, etc. are formed, and through the reaction of a cyan coupler with the oxidized product of an aromatic primary amine type color developing agent, dyes such as indoaniline dye, etc. are formed.

Among them, for formation of a magenta color image, 5-pyrazolone, cyanoacetophenone, indazolone, pyrazolobenzimidazole, pyrazolotriazole type couplers, etc. may be used.

In the prior art, most of the magenta color image forming couplers practically used have been 5-pyrazolone type couplers. The color image formed from a 5-pyrazolone type coupler is excellent in fastness to light and heat but is not satisfactory in the tone of the dye. This is due to an unnecessary absorption in the yellow component existing at around 430 nm and also the absorption spectrum of visible light at around 550 nm being broad, whereby color turbidity may cause the photographic image to lack clearness.

As the coupler having no such unnecessary absorption, 1H-pyrazolo[3,2-c]-s-triazole type coupler, 1H-imidazo[1,2-b]-pyrazole type coupler, 1H-pyrazolo[1,5-b]-pyrazole type coupler or 1H-prazolo[1,5-d]tetrazole type coupler as disclosed in U.S. Pat. No. 3,725,067; Japanese Provisional Patent Publications No. 162548/1984 and No. 171956/1984 is particularly excellent.

However, the dye color images formed from these couplers have very low fastness to light. When these couplers are used for light-sensitive materials, particularly those suitable for direct viewing, images will be impaired by usual conditions of storage and use.

Thus, they have disadvantages in practical application. Accordingly, as a method for improving light resistance, it has been proposed to use a phenol type or phenylether type antioxidant, as disclosed in Japanese Provisional Patent Publication No. 125732/1984. However, no satisfactory effect improving light resistance could be obtained.

On the other hand, there exist a coupler having good light-resistance according to the structure of the above magenta couplers. However, they have little fastness of color image to heat or humidity and as a result, they have a disadvantage that a magenta dye is changed to blue color or to red color.

Thus, a method for preventing color change or fading which has sufficiently great light-resistance and is resists color change due to heat or humidity is desired.

SUMMARY OF THE INVENTION

With reference to preventing color change or fading as mentioned above, an object of the present invention is to provide a light-sensitive silver halide photographic material which is excellent in color reproducibility and improved in fastness of magenta color image to light, heat and humidity.

The above objects of the present invention have been accomplished by a light-sensitive silver halide photographic material, which comprises a magenta coupler represented by the formula (I) shown below; a compound represented by the formula (XI) shown below; and further at least one compound selected from the group consisting of the compounds represented by the formulae (XII), (XIII) and (XIV) shown below:

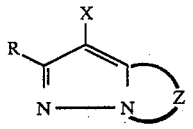

(I)

In the formula, Z represents a group of non-metallic atoms necessary for forming a nitrogen-containing heterocyclic ring which may have a substituent.

X represents a hydrogen atom or a substituent eliminable through the reaction with the oxidized product of a color developing agent.

Further, R represents a hydrogen atom or a substituent.

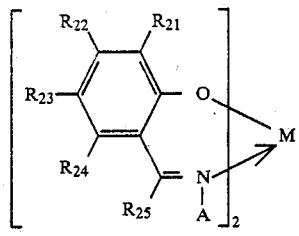

(XI)

In the above formula, $R_{21}$, $R_{22}$, $R_{23}$ and $R_{24}$ each represent a hydrogen atom, a halogen atom, a hydroxy group, a cyano group, or an alkyl group, an aryl group, a cycloalkyl group or a heterocyclic group each of which are bonded to carbon atom directly or via a divalent linking group. Further, $R_{21}$ and $R_{22}$, $R_{22}$ and $R_{23}$, or $R_{23}$ and $R_{24}$ may be formed a 6-membered ring by linking with each other.

$R_{25}$ represents a hydrogen atom, an alkyl group or an aryl group. A represents a hydrogen atom, alkyl group, an aryl group or a hydroxy group. M represents a metal atom.

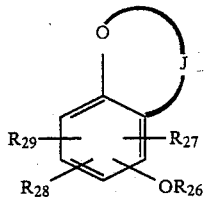

(XII)

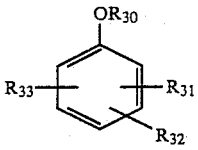

(XIII)

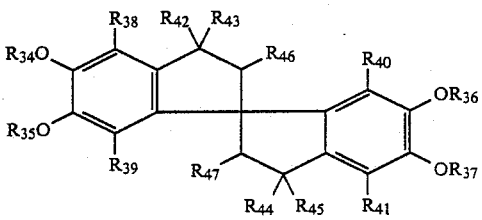

(XIV)

In the above formulae (XII), (XIII) and (XIV), $R_{26}$ and $R_{30}$ each represent a hydrogen atom, an alkyl group, an acyl group, a sulfonyl group, a carbamoyl group, a sulfamoyl group, an alkoxycarbonyl group or a trialkylsilyl group. J represents a group of non-metallic atoms necessary for forming a 5- or 6-membered ring with a carbon atom or an oxygen atom to be bonded and each of 5- or 6-membered ring may have a bis-spiro bond. $R_{27}$, $R_{28}$ and $R_{29}$ each represent a hydrogen atom, an alkyl group, an alkoxy group, an aryl group, an aryloxy group, an alkenyl group, an alkenoxy group, an acylamino group, a diacylamino group, a halogen atom, an alkylthio group, an arylthio group, an alkoxycarbonyl group, an acyloxy group, an acyl group or a sulfonamide group. $R_{31}$, $R_{32}$ and $R_{33}$ each represent a hydrogen atom, a hydroxyl group, an alkyl group, an alkenyl group, an alkoxy group, an aryl group, an aryloxy group, and acyloxy group, an alkoxycarbonyl group, an alkylthio group or an arylthio group, provided that the total carbon number of $R_{31}$, $R_{32}$ and $R_{33}$ is 8 or more.

In the formula (XIV), $R_{34}$, $R_{35}$, $R_{36}$ and $R_{37}$ each represent a hydrogen atom, an alkyl group, an alkenyl group, an aryl group, a heterocyclic group, a $R_{48}$—CO— group, a $R_{49}$—$SO_2$— group or a $R_{50}$—NHCO— group; $R_{38}$, $R_{39}$, $R_{40}$ and $R_{41}$ each represent a hydrogen atom, a halogen atom, an alkyl group, an alkenyl group, an alkoxy group or an alkenoxy group. $R_{42}$, $R_{43}$, $R_{44}$, $R_{45}$, $R_{46}$ and $R_{47}$ each represent a hydrogen atom, an alkyl group, an alkenyl group or an aryl group. $R_{48}$, $R_{49}$ and $R_{50}$ each represent an alkyl group, an alkenyl group, an aryl group or a heterocyclic group.

DESCRIPTION OF THE PREFERRED EMBODIMENTS

The present invention is to be described in detail below.

In the magenta coupler according to the present invention represented by the above formula (I),

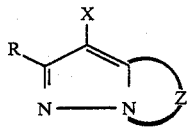

(I)

Z represents a group of non-metallic atoms necessary for forming a nitrogen-containing heterocyclic group and the ring formed by said Z may have a substituent.

X represents a hydrogen atom or a substituent eliminable through the reaction with the oxidized product of a color developing agent.

R represents a hydrogen atom or a substituent.

As the substituent represented by R, there may be mentioned, for example, a halogen atom, an alkyl group, a cycloalkyl group, an alkenyl group, a cycloalkenyl group, an alkynyl group, an aryl group, a heterocyclic group, an acyl group, a sulfonyl group, a sulfinyl group, a phosphonyl group, a carbamoyl group, a sulfamoyl group, a cyano group, a spiro compound residual group, a bridged hydrocarbon compound residual group, an alkoxy group, an aryloxy group, a heterocyclicoxy group, a siloxy group, an acyloxy group, a carbamoyloxy group, an amino group, an acylamino group, a sulfonamide group, an imide group, a ureido group, a sulfamoylamino group, an alkoxycarbonylamino group, an aryloxycarbonylamino group, an alkoxycarbonyl group, an aryloxycarbonyl group, an alkylthio group, an arylthio group and a heterocyclicthio group.

As halogen atoms, for example, chlorine atom, bromine atom may be used, particularly preferably chlorine atom.

The alkyl group represented by R may include preferably those having 1 and 32 carbon atoms, the alkenyl group or the alkynyl group those having 2 to 32 carbon atoms and the cycloalkyl group or the cycloalkenyl group those having 3 to 12 carbon atoms, particularly 5 to 7 carbon atoms. The alkyl group, alkenyl group or alkynyl group may be either straight or branched.

These alkyl group, alkenyl group, alkynyl group, cycloalkyl group and cycloalkenyl group may also have substituents [e.g. an aryl group, a cyano group, a halogen atom, a heterocyclic ring, a cycloalkyl group, a cycloalkenyl group, a spiro ring compound residual group, a bridged hydrocarbon compound residual group; otherwise those substituted through a carbonyl group such as an acyl group, a carboxy group, a carbamoyl group, an alkoxycarbonyl group and an aryloxycarbonyl group; further those substituted through a hetero atom, specifically those substituted through a oxygen atom such as of a hydroxy group, an alkoxy group, an aryloxy group, a heterocyclicoxy group, a siloxy group, an acyloxy group, a carbamoyloxy group, etc.; those substituted through a nitrogen atom such as of a nitro group, an amino (including a dialkylamino group, etc.), a sulfamoylamino group, an alkoxycarbonylamino group, an aryloxycarbonylamino group, an acylamino group, a sulfonamide group, an imide group, an ureido group, etc.; those substituted through a sulfur atom such as of an alkylthio group, an arylthio group, a heterocyclicthio group, a sulfonyl group, a sulfinyl group, a sulfamoyl group, etc.; and those substituted through a phosphorus atom such as of a phosphonyl group, etc.].

More specifically, there may be included, for example, a methyl group, an ethyl group, an isopropyl group, a t-butyl group, a pentadecyl group, a heptadecyl group, a 1-hexynonyl group, a 1,1'-dipentylnonyl group, a 2-chloro-t-butyl group, a trifluoromethyl group, a 1-ethoxytridecyl group, a 1-methoxyisopropyl group, a methanesulfonylethyl group, a 2,4-di-t-amylphenoxymethyl group, an anilino group, a 1-phenylisopropyl group, a 3-m-butanesulfoneaminophenoxypropyl group, a 3,4'-{α-[4''-(p-hydroxybenzenesulfonyl)-phenoxy]dodecanoylamino}phenylpropyl group, a 3-{4'-[α-(2'', 4''-di-t-amylphenoxy)butaneamido]phenyl}propyl group, a 4-[α-(o-chlorophenoxy)tetradecaneamidophenoxy]propyl group, an allyl group, a cyclopentyl group, a cyclohexyl group, and so on.

The aryl group represented by R may preferably be a phenyl group, which may also have a substituent (e.g. an alkyl group, an alkoxyl group, an acylamino group, etc.).

More specifically, there may be included a phenyl group, a 4-t-butylphenyl group, a 2,4-di-t-amylphenyl group, a 4-tetradecaneamidophenyl group, a hexadecyloxyphenyl group, a 4'-[α-(4''-t-butylphenoxy)tetradecaneamido]phenyl group and the like.

The heterocyclic group represented by R may preferably be a 5- to 7-membered ring, which may either be substituted or fused. More specifically, a 2-furyl group, a 2-thienyl group, a 2-pyrimidinyl group, a 2-benzothiazolyl group, etc. may be mentioned.

The acyl group represented by R may be, for example, an alkylcarbonyl group such as an acetyl group, a phenylacetyl group, a dodecanoyl group, an α-2,4-di-t-amylphenoxybutanoyl group and the like; and arylcarbonyl group such as a benzoyl group, a 3-pentadecyloxybenzoyl group, a p-chlorobenzoyl group and the like.

The sulfonyl group represented by R may include alkylsulfonyl groups such as a methylsulfonyl group, a dodecylsulfonyl group and the like; arylsulfonyl groups such as a benzenesulfonyl group, a p-toluenesulfonyl group and the like.

Examples of the sulfinyl group represented by R are alkylsulfinyl groups such as an ethylsulfinyl group, an octylsulfinyl group, a 3-phenoxybutylsulfinyl group and the like; arylsulfinyl groups such as a phenylsulfinyl group, a m-pentadecylphenylsulfinyl group and the like.

The phosphonyl group represented by R may be exemplified by alkylphosphonyl groups such as a butyloctylphoshonyl group and the like; alkoxyphosphonyl groups such as an octyloxphosphonyl group and the like; aryloxyphosphonyl groups such as a phenoxyphosphonyl group and the like; and arylphosphonyl groups such as a phenylphosphonyl group and the like.

The carbamoyl group represented by R may be substituted by an alkyl group, an aryl group (preferably a phenyl group), etc., including, for example, an N-methylcarbamoyl group, an N,N-dibutylcarbamoyl group, an N-(2-pentadecyloctylethyl)carbamoyl group, an N-ethyl-N-dodecylcarbamoyl group, an N-{3-(2,4-di-t-amylphenoxy)propyl}carbamoyl group and the like.

The sulfamoyl group represented by R may substituted by an alkyl group, an aryl group (preferably a phenyl group), etc., including, for example, an N-propylsulfamoyl group, an N,N-diethylsulfamoyl group, an N-(2-pentadecyloxyethyl)sulfamoyl group, an N-ethyl-N-dodecylsulfamoyl group, an N-phenylsulfamoyl group and the like.

The spiro compound residue represented by R may be, for example, spiro[3.3]heptan-1-yl and the like.

The bridged hydrocarbon residual group represented by R may be, for example, bicyclo[2.2.1]heptan-1-yl, tricyclo[3.3.1.1$^{3,7}$]decan-1-yl, 7,7-dimethylbicyclo[2.2.1]heptan-1-yl and the like.

The alkoxy group represented by R may be substituted by those as mentioned above as substituents for alkyl groups, including a methoxy group, a propoxy group, a 2-ethoxyethoxy group, a pentadecyloxy group, a 2-dodecyloxyethoxy group, a phenethyloxyethoxy group and the like.

The aryloxy group represented by R may preferably be a phenyloxy group of which the aryl nucleus may be further substituted by those as mentioned above as substituents or atoms for the aryl groups, including, for example, a phenoxy group, a p-t-butylphenoxy group, a m-pentadecylphenoxy group and the like.

The heterocyclicoxy group represented by R may preferably be one having a 5 - to 7-membered hetero ring, which hetero ring may further have substituents, including a 3,4,5,6-tetrahydropyranyl-2-oxy group, a 1-phenyltetrazole-5-oxy group and the like.

The siloxy group represented by R may further be substituted by an alkyl group, etc., including a siloxy group, a trimethylsiloxy group, a triethylsiloxy group, a dimethylbutylsiloxy group and the like.

The acyloxy group represented by R may be exemplified by an alkylcarbonyloxy group, an arylcarbonyloxy group, etc., which may further have substituents, including specifically an acetyloxy group, an α-chloroacetyloxy group, a benzoyloxy and the like.

The carbamoyloxy group represented by R may be substituted by an alkyl group, an aryl group, etc., including an N-ethylcarbamoyloxy group, an N,N-diethylcarbamoyloxy group, an N-phenylcarbamoyloxy group and the like.

The amino group represented by R may be substituted by an alkyl group, an aryl group (preferably a phenyl group), etc., including an ethylamino group, an anilino group, a m-chloroanilino group, a 3-pentadecyloxycarbonylanilino group, a 2-chloro-5-hexadecaneamidoanilino group and the like.

The acylamino group represented by R may include an alkylcarbonylamino group, an arylcarbonylamino group (preferably a phenylcarbonylamino group), etc., which may further have substituents, specifically an acetamide group, an 60-ethylpropaneamide group, an N-phenylacetamide group, a dodecaneamide group, a 2,4-di-t-amylphenoxyacetoamide group, an α-3-t-butyl-4-hydroxyphenoxybutaneamide group and the like.

The sulfonamide group represented by R may include an alkylsulfonylamino group, an arylsulfonylamino group, etc., which may further have substituents, specifically a methylsulfonylamino group, a pentadecylsulfonylamino group, a benzenesulfonamide group, a p-toluenesulfonamide group, a 2-methoxy-5-t-amylbenzenesulfonamide and the like.

The imide group represented by R may be either open-chained or cyclic, which may also have substituents, as exemplified by a succinimide group, a 3-heptadecylsuccinimide group, a phthalimide group, a glutarimide group and the like.

The ureido group represented by R may substituted by an alkyl group, an aryl group (preferably a phenyl group), etc., including an N-ethylureido group, an N-methyl-N-decylureido group, an N-phenylureido group, an N-p-tolylureido group and the like.

The sulfamoylamino group represented by R may be substituted by an alkyl group, an aryl group (preferably a phenyl group), etc., including an N,N-dibutylsulfamoylamino group, an N-methylsulfamoylamino group, an N-phenylsulfamoylamino group and the like.

The alkoxycarbonylamino group represented by R may further have substituents, including a methoxycarbonylamino group, a methoxyethoxycarbonylamino group, an octadecyloxycarbonylamino group and the like.

The aryloxycarbonylamino group represented by R may have substituents, and may include a phenoxycarbonylamino group, a 4-methylphenoxycarbonylamino group and the like.

The alkoxycarbonyl group represented by R may further have substituents, and may include a methoxycarbonyl group, a butyloxycarbonyl group, a dodecyloxycarbonyl group, an octadecyloxycarbonyl group, an ethoxymethoxycarbonyloxy group, an benzyloxycarbonyl group and the like.

The aryloxycarbonyl group represented by R may further have substituents, and may include a phenoxycarbonyl group, a p-chlorophenoxycarbonyl group, a m-pentadecyloxphenoxycarbonyl group and the like.

The alkylthio group represented by R may further have substituents, and may include an ethylthio group, a dodecylthio group, an octadecylthio group, a phnethylthio group, a 3-phenoxypropylthio group and the like.

The arylthio group represented by R may preferably be a phenylthio group, which may further have substituents, and may include, for example, a phenylthio group, a p-methoxyphenylthio group, a 2-t-octylphenylthio group, a 3-octadecylphenylthio group, a 2-carboxyphenylthio group, a p-acetaminophenylthio group and the like.

The heterocyclicthio group represented by R may preferably be a 5- to 7-membered heterocyclicthio group, which may further have a fused ring or have substituents, including, for example, a 2-pyridylthio group, a 2-benzothiazolylthio group, a 2,4-di-phenoxy-1,3,5-triazole-6-thio group and the like.

The atom eliminable through the reaction with the oxidized product of a color developing agent represented by X may include halogen atoms (e.g. a chlorine atom, a bromine atom, a fluorine atom, etc.) and also groups substituted through a carbon atom, an oxygen atom, a sulfur atom or a nitrogen atom.

The group substituted through a carbon atom may include the groups represented by the formula:

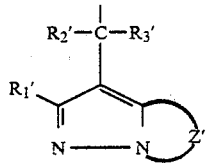

wherein $R_1'$ has the same meaning as the above R, Z' has the same meaning as the above Z, $R_2'$ and $R_3'$ each represent a hydrogen atom, an aryl group, an alkyl group or a heterocyclic group, a hydroxymethyl group and a triphenylmethyl group.

The group substituted through an oxygen atom may include an alkoxy group, an aryloxy group, a heterocyclicoxy group, an acyloxy group, a sulfonyloxy group, an alkoxycarbonyloxy group, an aryloxycarbonyloxy group, an alkyloxalyloxy group, an alkoxyoxalyloxy groups.

Said alkoxy group may further have substituents, including an ethoxy group, a 2-phenoxyethoxy group, a 2-cyanoethoxy group, a phenethyloxy group, a p-chlorobenzyloxy group and the like.

Said aryloxy group may preferably be a phenoxy group, which aryl group may further have substituents. Specific examples may include a phenoxy group, a 3-methylphenoxy group, a 3-dodecylphenoxy group, a 4-methanesulfonamidophenoxy group, a 4-[α-(3'-pentadecylphenoxy)butaneamido]phenoxy group, a hexadecylcarbamoylmethoxy group, a 4-cyanophenoxy group, a 4-methanesulfonylphenoxy group, a 1-naphthyloxy group, a p-methoxyphenoxy group and the like.

Said heterocyclicoxy group may preferably be a 5- to 7-membered heteroxyclicoxy group, which may be a fused ring or have substituents. Specifically, a 1-phenyltetrazolyloxy group, a 2-benzothiazolyloxy group and the like may be included.

Said acyloxy group may be exemplified by an alkylcarbonyloxy group such as an acetoxy group, a butanoyloxy group, etc.; an alkenylcarbonyloxy group such as a cinnamoyloxy group; an arylcarbonyloxy group such as a benzoyloxy group.

Said sulfonyloxy group may be, for example, a butanesulfonyloxy group, a methanesulfonyloxy group and the like.

Said alkoxycarbonyloxy group may be, for example, an ethoxycarbonyloxy group, a benzyloxycarbonyloxy group and the like.

Said aryloxycarbonyl group may be, for example, a phenoxycarbonyloxy group and the like.

Said alkyloxalyloxy group may be, for example, a methyloxalyloxy group.

Said alkoxyoxalyloxy group may be, for example, an ethoxyoxalyloxy group and the like.

The group substituted through a sulfur atom may include an alkylthio group, an arylthio group, heterocyclicthio group, an alkyloxythiocarbonylthio groups.

Said alkylthio group may include a butylthio group, a 2-cyanoethylthio group, a phenethylthio group, a benzylthio group and the like.

Said arylthio group may include a phenylthio group, a 4-methanesulfonamidophenylthio group, a 4-dodecylphenethylthio group, a 4-nonafluoropentaneamidophenethylthio group, a 4-carboxyphenylthio group, a 2-ethoxy-5-t-butylphenylthio group and the like.

Said heterocyclicthio group may be, for example, a 1-phenyl-1,2,3,4-tetrazolyl-5-thio group, a 2-benzothiazolylthio group and the like.

Said alkyloxythiocarbonylthio group may include a dodecyloxythiocarbonylthio group and the like.

The group substituted through a nitrogen atom may include, for example, those represented by the formula:

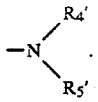

Here, $R_4'$ and $R_5'$ each represent a hydrogen atom, an alkyl group, an aryl group, a heterocyclic group, a sulfamoyl group, a carbamoyl group, an acyl group, a sulfonyl group, an aryloxycarbonyl group or an alkoxycarbonyl group. $R_4'$ and $R_5'$ may be bonded to each other to form a hetero ring. However, $R_4'$ and $R_5'$ cannot both be hydrogen atoms.

Said alkyl group may be either straight or branched, having preferably 1to 22 carbon atoms. Also, the alkyl group may have substituents such as an aryl group, an alkoxy group, an aryloxy group, an alkylthio group, an arylthio group, an alkylamino group, an arylamino group, an acylamino group, a sulfonamide group, an imino group, an acyl group, an alkylsulfonyl group, an arylsulfonyl group, a carbamoyl group, a sulfamoyl group, an alkoxycarbonyl group, an aryloxycarbonyl group, an alkyloxycarbonylamino group, an aryloxycarbonylamino group, a hydroxyl group, a carboxyl group, a cyano group, halogen atoms, etc. Typical examples of said alkyl group may include an ethyl group, an octyl group, a 2-ethylhexyl group, a 2-chloroethyl group and the like.

The aryl group represented by $R_4'$ or $R_5'$ may preferably have 6 to 32 carbon atoms, particularly a phenyl group or a naphthyl group, which aryl group may also have substituents such as those as mentioned above for substituents on the alkyl group represented by $R_4'$ or $R_5'$ and alkyl groups. Typical examples of said aryl group may be, for example, a phenyl group, a 1-naphtyl group, a 4-methylsulfonylphenyl group and the like.

The heterocyclic group represented by $R_4'$ or $R_5'$ may preferably a 5- or 6-membered ring, which may be a fused ring or have substituents. Typical examples may include a 2-furyl group, a 2-quinolyl group, a 2-pyrimidyl group, a 2-benzothiazolyl group, a 2-pyridyl group and the like.

The sulfamoyl group represented by $R_4'$ or $R_5'$ may include an N-alkylsulfamoyl group, an N,N-dialkylsulfamoyl group, an N-arylsulfamoyl group, an N,N-diarylsulfamoyl group and the like, and these alkyl and aryl groups may have substituents as mentioned above for the alkyl groups and aryl groups. Typical examples of the sulfamoyl group are, for example, an N,N-diethylsulfamoyl group, an N-methylsulfamoyl group, an N-dodecylsulfamoyl group, an N-p-tolylsulfamoyl group and the like.

The carbamoyl group represented by $R_4'$ or $R_5'$ may include an N-alkylcarbamoyl group, an N,N-dialkylcarbamoyl group, an N-arylcarbamoyl group, an N,N-diarylcarbamoyl group and the like, and these alkyl and aryl groups may have substituents as mentioned above for the alkyl groups and aryl groups. Typical examples of the carbamoyl group are an N,N-diethylcarbamoyl group, an N-methylcarbamoyl group, an N-dodecylcarbamoyl group, an N-p-cyanocarbamoyl group, an N-p-tolylcarbamoyl group and the like.

The acyl group represented by $R_4'$ or $R_5'$ may include an alkylcarbonyl group, an arylcarbonyl group, a heterocyclic carbonyl group, which alkyl group, aryl group and heterocyclic group may have substituents. Typical examples of the acyl group are a hexafluorobutanoyl group, a 2,3,4,5,6-pentafluorobenzoyl group, an acetyl group, a benzoyl group, a naphthoyl group, a 2-furylcarbonyl group and the like.

The sulfonyl group represented by $R_4'$ or $R_5'$ may be, for example, an alkylsulfonyl group, an arylsulfonyl group or a heterocyclic sulfonyl group, which may also have substituents, including specifically an ethanesulfonyl group, a benzenesulfonyl group, an octanesulfonyl group, a naphthalenesulfonyl group, a p-chlorobenzenesulfonyl group and the like.

The aryloxycarbonyl group represented by $R_4'$ or $R_5'$ may have substituents as mentioned for the above aryl group, including specifically a phenoxycarbonyl group and the like.

The alkoxycarbonyl group represented by $R_4'$ or $R_5'$ may have substituents as mentioned for the above alkyl group, and its specific examples are a methoxycarbonyl group, a dodecyloxycarbonyl group, a benzyloxycarbonyl group and the like.

The heterocyclic ring formed by bonding between $R_4'$ and $R_5'$ may preferably be a 5- or 6-membered ring, which may be either saturated or unsaturated, either has aromaticity or not, or may also be a fused ring. Said heterocyclic ring may include, for example, an N--phthalimide group, an N-succinimide group, a 4-N-urazolyl group, a 1-N-hydantoinyl group, a 3-N-2,4-dioxooxazolidinyl group, a 2-N-1,1-dioxo-3-(2H) -oxo-1,2-benzthiazolyl group, a 1-pyrrolyl group, a 1-pyrrolidinyl group, a 1-pyrazolyl group, a 1-pyrazolidinyl group, a 1-piperidinyl group, a 1-pyrrolinyl group, a 1-imidazolyl group, a 1-imidazolinyl group, a 1-indolyl group, a 1-isoindolinyl group, a 2-isoindolyl group, a 2-isoindolinyl group, a 1-benzotriazolyl group, a 1-benzoimidazolyl group, a 1-(1,2,4-triazolyl) group, a 1-(1,2,3-triazolyl) group, a 1-(1,2, 3,4-tetrazolyl) group, an N-morpholinyl group, a 1,2,3,4-tetrahydroquinolyl group, a 2-oxo-1-pyrrolidinyl group, a 2-1H-pyrridone group, a phthaladione group, a 2-oxo-1-piperidinyl group, etc. These heterocyclic groups may be substituted by an alkyl group, an aryl group, an alkyloxy group, an aryloxy group, an acyl group, a sulfonyl group, an alkylamino group, an arylamino group, an acylamino group, a sulfonamino group, a carbamoyl group, a sulfamoyl group, an alkylthio group, an arylthio group, a ureido group, an alkoxycarbonyl group, an aryloxycarbonyl group, an imide group, a nitro group, a cyano group, a carboxyl group or halogen atoms.

The nitrogen-containing heterocyclic ring formed by Z and Z' may include a pyrazole ring, a imidazole ring, a triazole ring or a tetrazole ring, and the substituents which may be possessed by the above rings may include those as mentioned for the above R.

When the substituent (e.g. R, $R_1$ to $R_8$) on the heterocyclic ring in the formula (I) and the formulae (II) to (VII) as hereinafter described has a moiety of the formula:

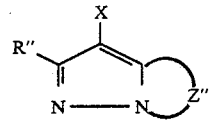

(wherein R'', X and Z'' have the same meanings as R, X and Z in the formula (I)), the so-called bis-form type coupler is formed, which is of course included in the present invention. The ring formed by Z, Z', Z'' and $Z_1$ as hereinafter described may also be fused with another ring (e.g. a 5- to 7-membered cycloalkene). For example, $R_5$ and $R_6$ in the formula [V], $R_7$ and $R_8$ in the formula (VI) may be bonded to each other to form a ring (e.g. a 5- to 7-membered rings).

The compounds represented by the formula (I) can be also represented specifically by the following formulae (II) through (VII).

(II)

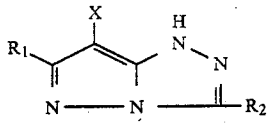

(III)

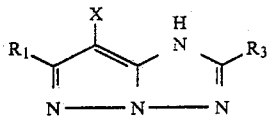

(IV)

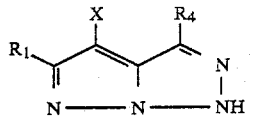

(V)

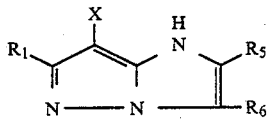

(VI)

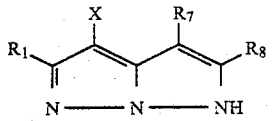

(VII)

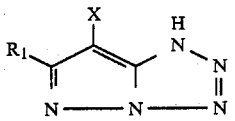

In the above formulae (II) to (VII), $R_1$ to $R_8$ and X have the same meanings as the above R and X.

Of the compounds represented by the formula (I), those represented by the following formula (VIII) are preferred.

(VIII)

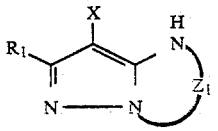

wherein $R_1$, X and $Z_1$ have the same meanings as R, X and Z in the formula (I).

Of the magenta couplers represented by the formulae (II) to (VII), the magenta coupler represented by the formula (II) is particularly preferred.

To describe about the substituents on the heterocyclic ring in the formulae (I) to (VIII), R in the formula (I) and $R_1$ in the formulae (II) to (VIII) should preferably satisfy the following condition 1, more preferably satisfy the following conditions 1 and 2, and particularly preferably satisfy the following conditions 1, 2 and 3:

Condition 1: a root atom directly bonded to the heterocyclic ring is a carbon atom, Condition 2: only one of hydrogen atom is bonded to said carbon atom or no hydrogen atom is bonded to it, and Condition 3: the bondings between the root atom and adjacent atoms are all single bonds.

Of the substituents R and $R_1$ on the above heterocyclic ring, most preferred are those represented by the formula (IX) shown below:

(IX)

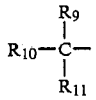

In the above formula, each of $R_9$, $R_{10}$ and $R_{11}$ represents a hydrogen atom, a halogen atom, an alkyl group, a cycloalkyl group, an alkenyl group, a cycloalkenyl group, an alkynyl group, an aryl group, a heterocyclic group, an acyl group, a sulfonyl group, a sulfinyl group, a phosphonyl group, a carbamoyl group, a sulfamoyl group, a cyano group, a spiro compound residual group, a bridged hydrocarbon compound residual group, an alkoxy group, an aryloxy group, a heterocyclicoxy group, a siloxy group, an acyloxy group, a carbamoyloxy group, an amino group, an acylamino group, a sulfonamide group, an imide group, a ureido group, a sulfamoylamino group, an alkoxycarbonylamino group, an aryloxycarbonylamino group, an alkoxycarbonyl group, an aryloxycarbonyl group, an alkylthio group, an arylthio group or a heterocyclicthio group.

Also, at least two of said $R_9$, $R_{10}$ and $R_{11}$, for example, $R_9$ and $R_{10}$ may be bonded together to form a saturated or unsaturated ring (e.g. cycloalkane ring, cycloalkene ring or heterocyclic ring), and further to form a bridged hydrocarbon compound residual group by bonding $R_{11}$ to said ring.

The groups represented by $R_9$ to $R_{11}$ may have substituents, and examples of the groups represented by $R_9$ to $R_{11}$ and the substituents which may be possessed by said groups may include examples of the substituents which may be possessed by the R in the above formula (I), and substituents which may be possessed by said substituents.

Also, examples of the ring formed by bonding between $R_9$ and $R_{10}$, the bridged hydrocarbon compound residual group formed by $R_9$ to $R_{11}$ and the substituents which may be possesed thereby may include examples of cycloalkyl, cycloalkenyl and heterocyclic groups as mentioned for substituents on the R in the aforesaid formula (I) and substituents thereof.

Of the compounds of the formula (IX), preferred are:

(i) the case where two of $R_9$ to $R_{11}$ are alkyl groups; and (ii) the case where one of $R_9$ to $R_{11}$, for example, $R_{11}$ is a hydrogen atom and two of the other $R_9$ and $R_{10}$ are bonded together with the root carbon atom to form a cycloalkyl group.

Further, preferred in (i) is the case where two of $R_9$ to $R_{11}$ are alkyl groups and the other one is a hydrogen atom or an alkyl group.

Here, said alkyl and said cycloalkyl may further have substituents, and examples of said alkyl, said cycloalkyl and substituents thereof may include those of alkyl, cycloalkyl and substituents thereof as mentioned for the substituents on the R in the formula (I) and the substituents thereof.

In the following, examples of the magenta coupler of the present invention are enumerated, which are not limitative of the present invention.

1
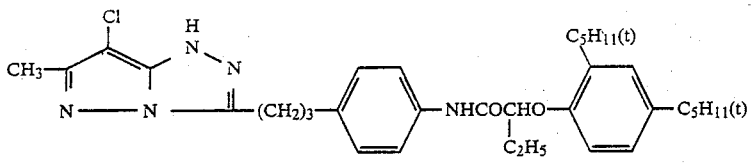
2
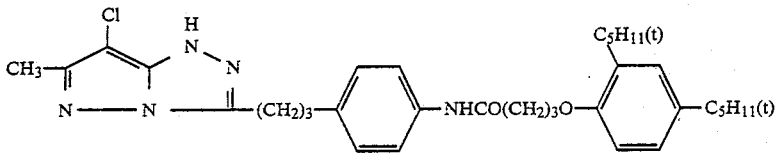
3
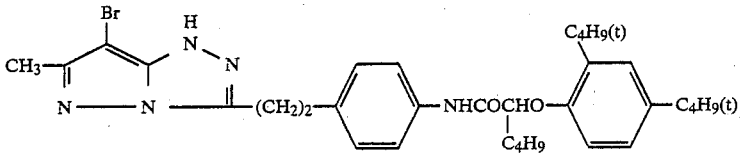
4
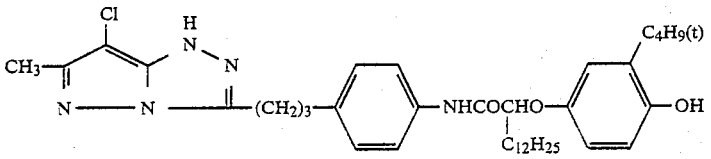
5
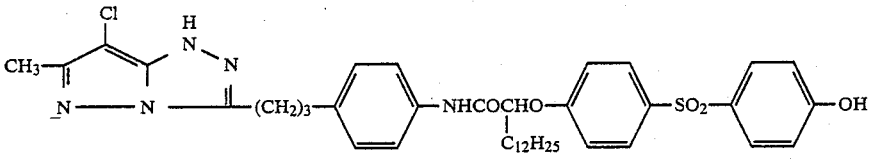
6
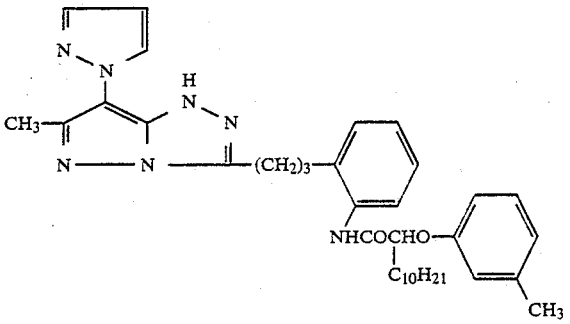
7
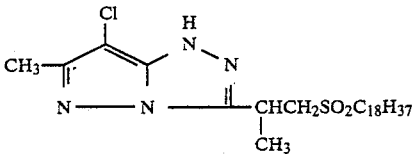
8
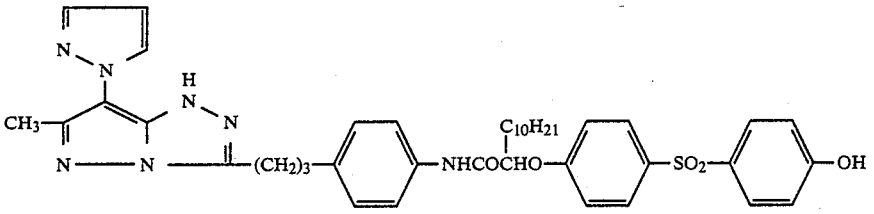

-continued
9
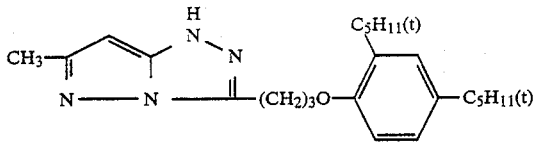
10
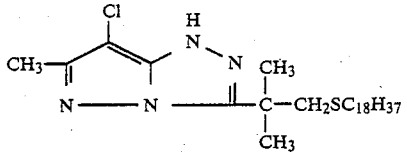
11
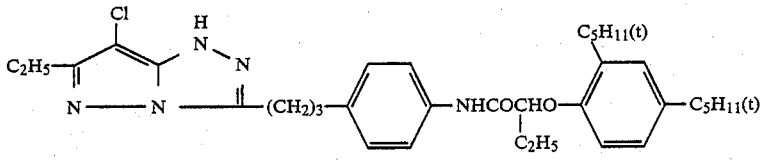
12
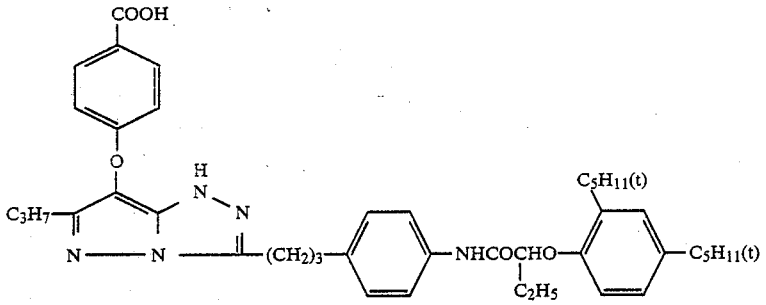
13
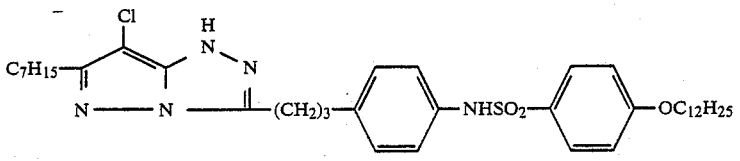
14
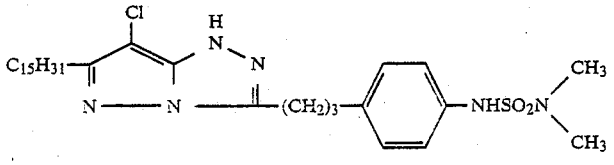
15
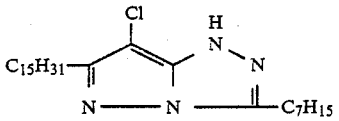
16
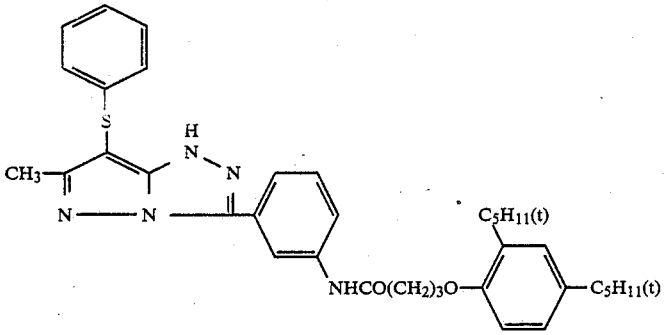

-continued
17
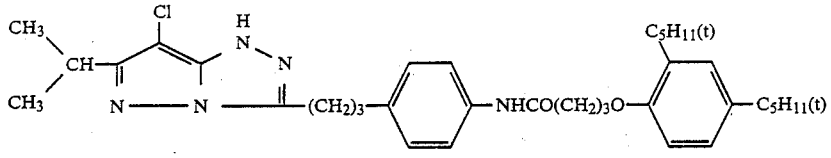
18
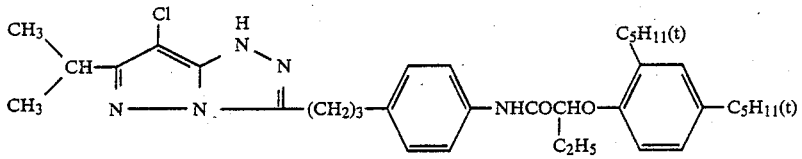
19
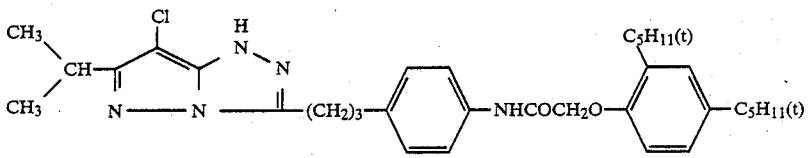
20
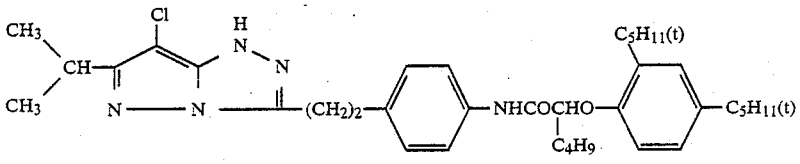
21
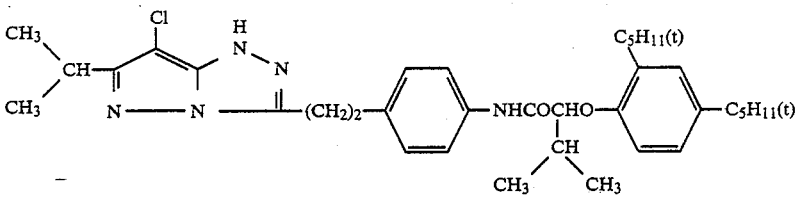
22
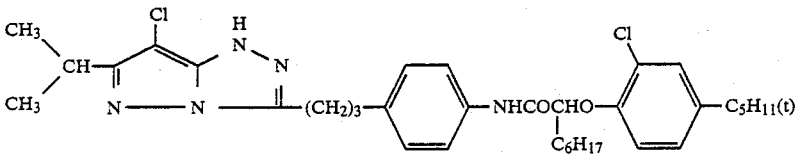
23
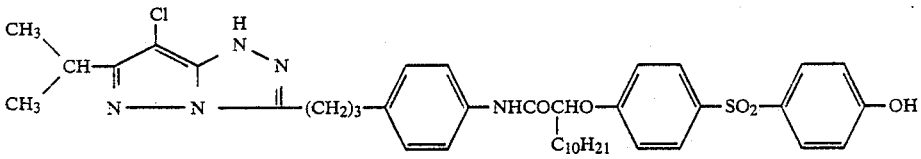
24
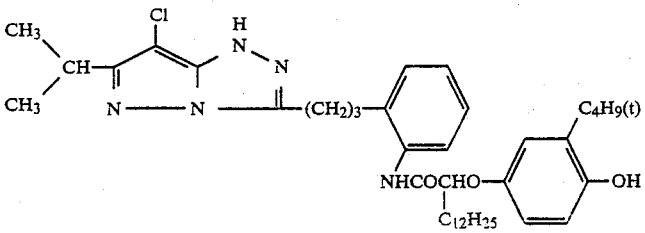
25
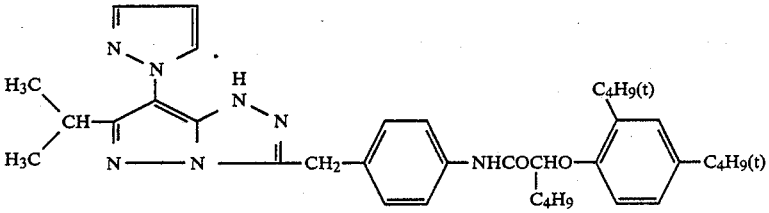

-continued

26

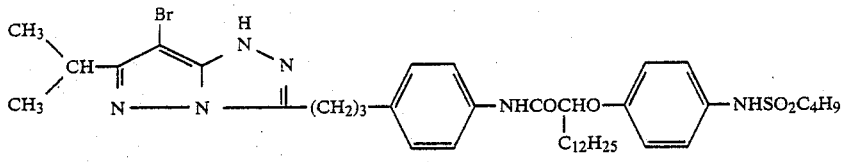

27

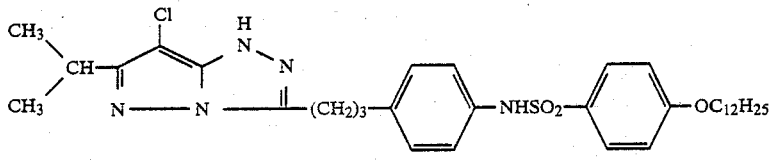

28

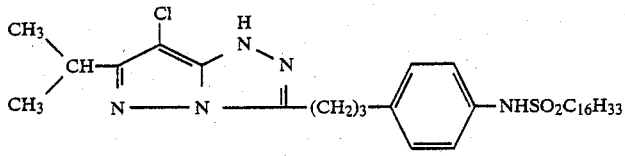

29

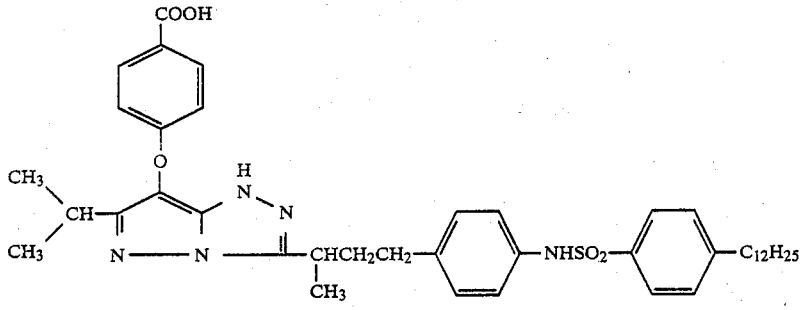

The above couplers were synthesized by referring to Journal of the Chemical Society, Perkin I (1977), pp. 2047-2052, U.S. Pat. No. 3,725,067, Japanese Provisional Patent Publications No. 99437/1984 and No. 42045/1984.

The coupler of the present invention can be used in an amount generally within the range of from $1\times10^{-3}$ mole to $5\times10^{-1}$ mole, preferably from $1\times10^{-2}$ to $5\times10^{31\ 1}$ mole, per mole of the silver halide.

The coupler of the present invention can be used in combination with other kinds of magenta couplers.

When the light-sensitive silver halide photographic material is used as a multi-color light-sensitive photographic material, a yellow coupler and a cyan coupler conventionally used in this field of the art can be used in a conventional manner. Also, a colored coupler having the effect of color correction or a coupler which releases a developing inhibitor with development (DIR coupler) may be used, if necessary. The above coupler can be used as a combination of two or more kinds in the same layer or the same coupler may be added into the two or more layers, in order to satisfy the characteristics demanded for the light-sensitive material.

As the cyan coupler and the yellow coupler to be used in the present invention, there may be employed phenol type or naphthol type cyan couplers and acylacetamide type or benzoylmethane type yellow couplers, respectively.

These yellow couplers are described in, for example, U.S. Pat. Nos. 2,778,658, No. 2,875,057, No. 2,908,573, No. 3,227,155, No. 3,227,550, No. 3,253,924, No. 3,265,506, No. 3,277,155, No. 3,341,331, No. 3,369,895, No. 3,384, 657, No. 3,408,194, No. 3,415,652, No. 3,447,928, No. 3,551,155, No. 3,582,322, No. 3,725,072, No. 3,894,875; West German Offenlegunsschrift No. 15 47 868, No. 20 57 941, No. 21 62 899, No. 21 63 812, No. 22 18 461, No. 22 19 917, No. 22 61 361 and No. 22 63 875; Japanese Patent Publication No. 13576/1974; Japanese Provisional Patent Publications No. 29432/1973, No. 66834/1973, No. 10736/1974, No. 122335/1974, No. 28834/1975 and No. 132926/1975.

The cyan couplers are described in, for example, U.S. Pat. Nos. 2,369,929, No. 2423,730, No. 2,434,272, No. 2,474,293, No. 2,698,794, No. 2,706,684, No. 2,772,162, No. 2,801,171, No. 2,895,826, No. 2,908,573, No. 3,034, 892, No. 3,046,129, No. 3,227,550, No. 3,253,294, No. 3,311,476, No. 3,86,301, No. 3,419,390, No. 3,458,315, No. 3,476,563, No. 3,516,831, No. 3,560,212, No. 3,582, 322, No. 3,583,971, No. 3,591,383, No. 3,619, 196, No. 3,632,347, No. 3,652,286, No. 3,737,326, No. 3,758,308, No. 3,779,763, No. 3,839,044 and No. 3,880,661; West German Offenlegunsschrift No. 21 63 811 and No. 22 07 468; Japanese Patent Publications No. 27563/1964 and No. 28836/1970; Japanese Provisional Patent Publications No. 37425/1972, No. 10135/1975, No. 25228/1975, No. 112038/1975, No. 117422/1975, No. 130441/1975, No. 109630/1978, No. 65134/1981 and No. 99341/1981; and Research Disclosure No. 14,853 (1976), etc.

In the present invention, the metal complex represented by the above formula (XI) may be used either singly, or a combination of two or more compounds.

The metal complex to be used in the present invention is represented by the formula (XI):

(XI)

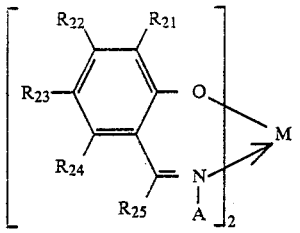

In the above formula, $R_{21}$, $R_{22}$, $R_{23}$ and $R_{24}$ each represent a hydrogen atom, a halogen atom, a hydroxy group, a cyano group, or an alkyl group, an aryl group, a cycloalkyl group or a heterocyclic group each of which are bonded to carbon atom directly or via a divalent linking group. Further, $R_{21}$ and $R_{22}$, $R_{22}$ and $R_{23}$, or $R_{23}$ and $R_{24}$ may be formed a 6-membered ring by bonding with each other.

$R_{25}$ represents a hydrogen atom, an alkyl group or an aryl group. A represents a hydrogen atom, alkyl group, an aryl group or a hydroxy group. M represents a metal atom.

The halogen atom represented by $R_{21}$, $R_{22}$, $R_{23}$ and $R_{24}$ may be mentioned a fluorine atom, a chlorine atom, bromine atom and iodine atom.

The alkyl group represented by $R_{21}$, $R_{22}$, $R_{23}$ and $R_{24}$ may preferably be an alkyl group having 1 to 19 carbon atoms which may be either a straight alkyl group or a branched alkyl group an may have a substituent.

The aryl group represented by $R_{21}$, $R_{22}$, $R_{23}$ and $R_{24}$ may preferably be an aryl group having 6 to 14 carbon atoms which may have substituent.

The heterocyclic group represented by $R_{21}$, $R_{22}$, $R_{23}$ and $R_{24}$ may preferably be 5-membered ring or 6-membered ring which may have substituent.

The cycloalkyl group represented by $R_{21}$, $R_{22}$, $R_{23}$ and $R_{24}$ may preferably be a 5-membered ring group or a 6-membered ring group which may have a substituent.

The 6-membered ring formed by linking $R_{21}$ and $R_{22}$ with each other may be mentioned, for example,

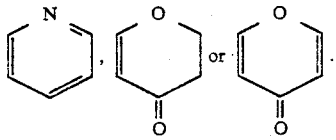

The 6-membered ring formed by linking $R_{22}$ and $R_{23}$ or $R_{23}$ and $R_{24}$ with each other may preferably be a benzene ring and the benzene ring may have a substituent or may be fused one.

The alkyl group represented by $R_{21}$, $R_{22}$, $R_{23}$ and $R_{24}$ may be mentioned, for example, a methyl group, an ethyl group, a propyl group, a butyl group, a t-butyl group, a hexyl group, an octyl group, a decyl group, a dodecyl group, a tetradecyl group, a hexadecyl group and an octadecyl group.

The aryl group represented by $R_{21}$, $R_{22}$, $R_{23}$ and $R_{24}$ may be mentioned, for example, a phenyl group and a naphthyl group.

The heterocyclic ring group represented by $R_{21}$, $R_{22}$, $R_{23}$ and $R_{24}$ may preferably be a 5-or 6-membered heterocyclic group containing at least one of nitrogen atom, oxygen atom or sulfur atom as a hetero atom in the ring, and there may be mentioned, for example, a furyl group, a hydrofuryl group, a thienyl group, a pyrrolyl group, a pyrrolidyl group, a pyridyl group, an imidazolyl group, a pyrazolyl group, a quinolyl group, an indolyl group, an oxazolyl group, a thiazolyl group and the like.

As the cycloalkyl group represented by $R_{21}$, $R_{22}$, $R_{23}$ and $R_{24}$, there may be mentioned, for example, a cyclopentyl group, a cyclohexyl group, a cyclohexenyl group, a cyclohexadienyl group and the like.

As the 6-membered ring formed by linking $R_{21}$, $R_{22}$, $R_{23}$ and $R_{24}$ with each other, there may be mentioned, for example, a benzene ring, a naphthalene ring, an isobenzothiophene ring, an isobenzofuran ring, an isoindone ring and the like.

The above alkyl group, cycloalkyl group, aryl group or heterocyclic group represented by $R_{21}$, $R_{22}$, $R_{23}$ and $R_{24}$ may be bonded to carbon atom on a benzene ring through a divalent linking group such as an oxy group (—O—), a thio group (—S—), an amino group, an oxycarbonyl group, a carbonyl group, a carbamoyl group, a sulfamoyl group, a carbonylamino group, a sulfonylamino group, a sulfonyl group or a carbonyloxy group, and a preferred group is present among them.

Examples of the alkyl group represented by $R_{21}$, $R_{22}$, $R_{23}$ and $R_{24}$ which is bonded to carbon atom on the benzene ring through the above divalent linking group, may include, for example, an alkoxy group (e.g. a methoxy group, an ethoxy group, a butoxy group, a 2-ethylhexyloxy group, an n-decyloxy group, an n-dodecyloxy group, an n-hexadecyl group, etc.), an alkoxycarbonyl group (e.g. a methoxycarbonyl group, an ethoxycarbonyl group, a butoxycarbonyl group, an n-decyloxycarbonyl group, an n-hexadecyloxycarbonyl group, etc.), an acyl group (e.g. an acetyl group, a valeryl group, a stearoyl group, a benzoyl group, a toluoyl group, etc.), an acyloxy group (e.g. an acetoxy group, a hexadecylcarbonyloxy group, etc.), an alkylamino group (e.g. an n-butylamino group, an N,N-diethylamino group, an N,N-didecylamino group, etc.), an alkylcarbamoyl group (e.g. a butylcarbamoyl group, an N,N-diethylcarbamoyl group, an n-dodecylcarbamoyl group, etc.), an alkylsulfamoyl group (e.g. a butylsulfamoyl group, an N,N-diethylsulfamoyl group, an n-dodecylsulfamoyl group, etc.), a sulfonylamino group (e.g. a methylsulfonylamino group, an ethylsulfonylamino group, etc.), a sulfonyl group (e.g. a mesyl group, an ethanesulfonyl group, etc.), an acylamino group (e.g. an acetylamino group, a valerylamino group, a palmitoylamino group, a benzoylamino group, a toluoylamino group, etc.), and the like.

Examples of the alkyl group represented by $R_{21}$, $R_{22}$, $R_{23}$ and $R_{24}$ which is bonded to carbon atom on the ring through the above divalent linking group, may include a cyclohexyloxy group, a cyclohexylcarbonyl group, a cyclohexyloxycarbonyl group, a cyclohexylamino group, a cyclohexenylcarbonyl group, a cyclohexenyloxy group and the like.

Examples of the aryl group represented by $R_{21}$, $R_{22}$, $R_{23}$ and $R_{24}$ which is bonded to carbon atom on the ring through the above divalent linking group, may include an aryloxy group (e.g. a phenoxy group, a naphthoxy group, etc.), an aryloxycarbonyl group (e.g. a phenoxycarbonyl group, a naphthoxycarbonyl group, etc.), an acyl group (e.g. a benzoyl group, a naphthoyl group, etc.), an anilino group (e.g. a phenylamino group, an N-methylanilino group, an N-acetylanilino group, etc.), an acyloxy group (e.g. a benzoyloxy group, a toluoyloxy group, etc.), an arylcarbamoyl group (e.g. a phenylcarbamoyl group, etc.), an arylsulfamoyl group (e.g.

a phenylsulfamoyl group, etc.), an arylsulfonylamino group (e.g. a phenylsulfonylamino group, a p-tolylsulfonylamino group, etc.), an arylsulfonyl group (e.g. a benzenesulfonyl group, a tosyl group, etc.), an acylamino group (e.g. a benzoylamino group, etc.) and the like.

The above alkyl group, aryl group, heterocyclic group or cycloalkyl group represented by $R_{21}$, $R_{22}$, $R_{23}$ and $R_{24}$ or the 6-membered ring which is formed by linking $R_{21}$ and $R_{22}$, $R_{22}$ and $R_{23}$, or $R_{23}$ and $R_{24}$ with each other may be substituted by a substituent such as halogen atoms (e.g. a chlorine atom, a bromine atom, a fluorine atom, etc.), a cyano group, an alkyl group (e.g. a methyl group, an ethyl group, an iso-propyl group, a butyl group, a hexyl group, an octyl group, a decyl group, a dodecyl group, a tetradecyl group, a hexadecyl group, a heptadecyl group, an octadecyl group, a methoxyethoxyethyl group, etc.), an aryl group (e.g. a phenyl group, a tolyl group, a naphthyl group, a chlorophenyl group, a methoxyphenyl group, an acetylphenyl group, etc.), an alkoxy group (e.g. a methoxy group, an ethoxy group, a butoxy group, a propoxy group, a methoxyethoxy group, etc.), an aryloxy group (e.g. a phenoxy group, a tolyloxy group, naphthoxy group, a methoxyphenoxy group, etc.), an alkoxycarbonyl group (e.g. a methoxycarbonyl group, a butoxycarbonyl group, a phenoxymethoxycarbonyl group, etc.), an aryloxycarbonyl group (e.g. a phenoxycarbonyl group, a tolyloxycarbonyl group, a methoxyphenoxycarbonyl group, etc.), an acyl group (e.g. a formyl group, an acetyl group, a valeryl group, a stearoyl group, a benzoyl group, a toluoyl group, a naphthoyl group, a p-methoxybenzoyl group, etc.), an acyloxy group (e.g. an acetoxy group, an acyloxy group, etc.), an acylamino group (e.g. an acetamide group, a benzamide group, a methoxyacetamide group, etc.), an anilino group (e.g. a phenylamino group, an N-methylanilino group, an N-phenylanilino group, an N-acetylanilino group, etc.), an alkylamino group (e.g. an n-butylamino group, an N,N-diethylamino group, a 4-methoxy-n-butylamino group, etc.), a carbamoyl group (e.g. an n-butylcarbamoyl group, an N,N-diethylcarbamoyl group, etc.), a sulfamoyl group (e.g. an n-butylsulfamoyl group, an N,N-diethylsulfamoyl group, an n-dodecylsulfamoyl group, an N-(4-methoxy-n-butyl)sulfamoyl group, etc.), a sulfonamino group (e.g. a methylsulfonylamino group, a phenylsulfonylamino group, a methoxymethylsulfonylamino group, etc.), a sulfonyl group (e.g. a mesyl group, a tosyl group, a methoxymethanesulfonyl group, etc.) and the like.

The alkyl group represented by $R_{25}$ and A may have substituent and they may be either a straight or branched. These alkyl groups are an alkyl group having 1 to 20 carbon atoms except for carbon atoms at the substituent portion, and may include, for example, a methyl group, an ethyl group, a propyl group, a butyl group, a hexyl group, an oxtyl group a decyl group, a dodecyl group, a tetradecyl group, a hexadecyl group, a heptadecyl group, an octadecyl group, and the like.

The aryl group represented by $R_{25}$ and A may have a substituent and is an aryl group having 6 to 14 carbon atoms except for carbon atoms at the substituent portion, and may include, for example, a phenyl group, a tolyl group, a naphthyl group and the like. Further, two ligands may be linked through A.

M in the formula represents a metal atom, preferably a transition metal atom, more preferably, Cu, Co, Ni, Pd, Fe or Pt, particularly preferably Ni. Preferred group of A is a hydroxy group.

Among the complexes represented by the above formula (XI), preferably used are complexes where $R_{21}$ is an oxy group, a thio group, or an alkyl group, a cycloalkyl group, an aryl group or a heterocyclic group which are bonded through a carbonyl group, a hydroxy group or a fluorine atom, at least one of groups represented by $R_{22}$, $R_{23}$ or $R_{24}$ is a hydrogen atom, a hydroxy group, alkyl group or an alkoxy group. Among them, more preferred are those where $R_{25}$ is a hydrogen atom, and total carbon atoms of the groups represented by $R_{21}$, $R_{22}$, $R_{23}$ and $R_{24}$ are at least 4.

Typical examples of the metal complexes according to the present invention (hereinafter referred to an exemplary complexes) are shown below, but the present invention is not limited thereto.

XI-1

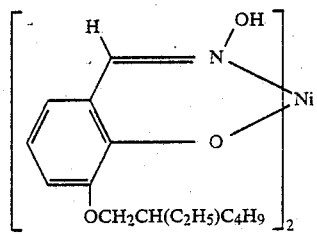

XI-2

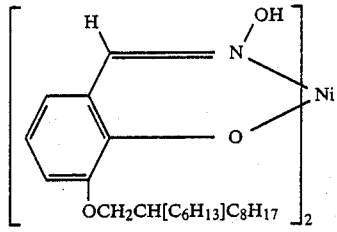

XI-3

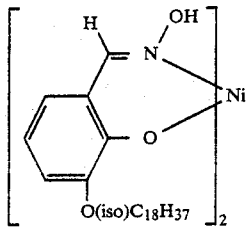

XI-4

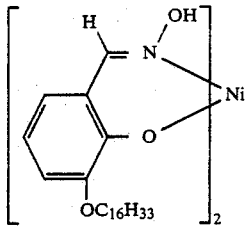

XI-5

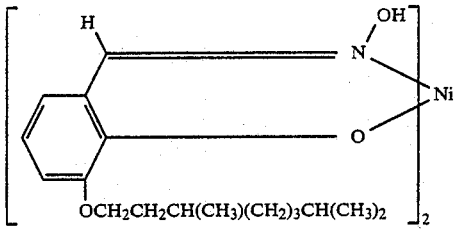

-continued
XI-6
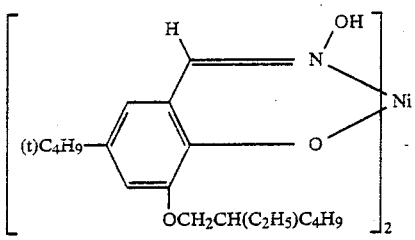
XI-7
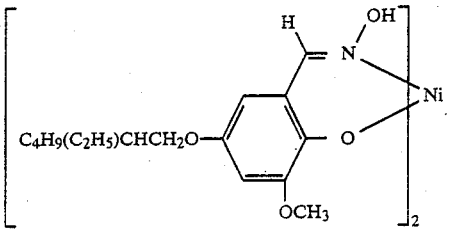
XI-8
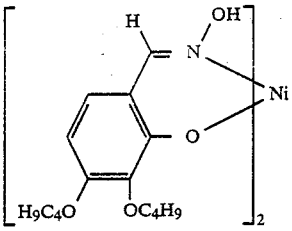
XI-9
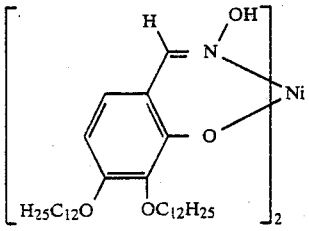
XI-10
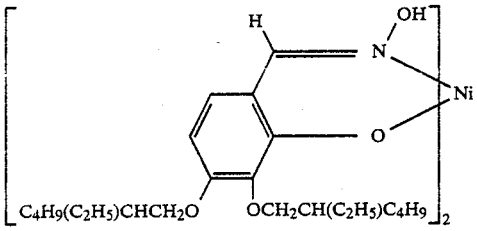
XI-11
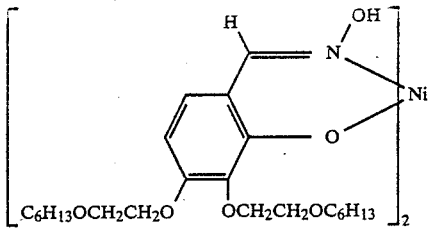
-continued
XI-12
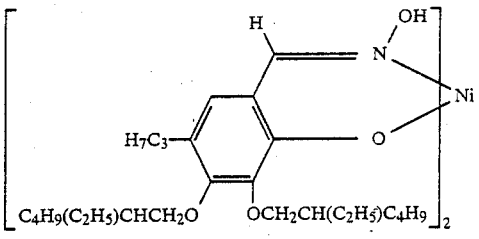
XI-13
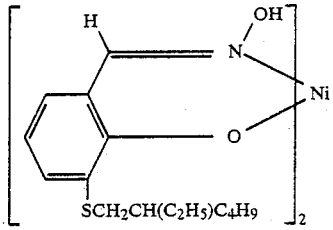
XI-14
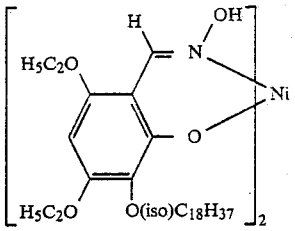
XI-15
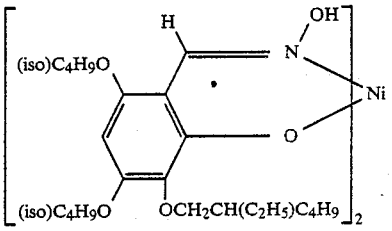
XI-16
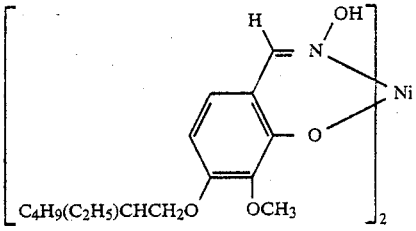
XI-17
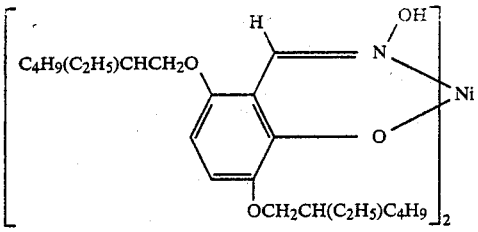

-continued
XI-18
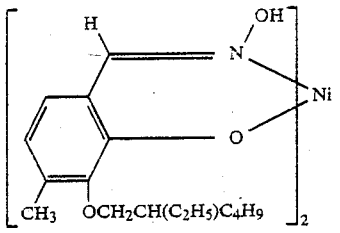
XI-19
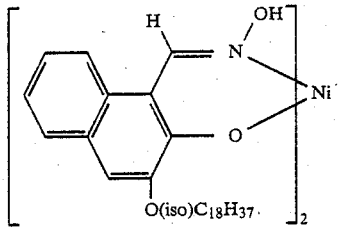
XI-20
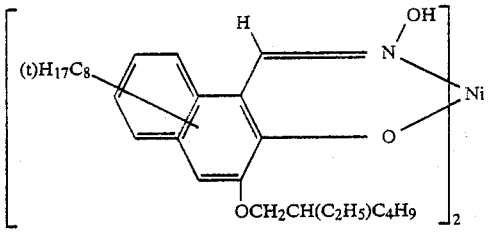
XI-21
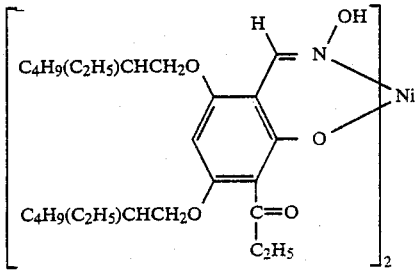
XI-22
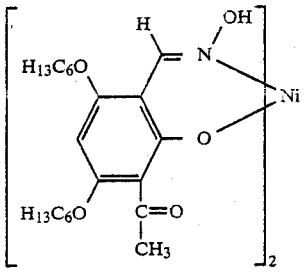
XI-23
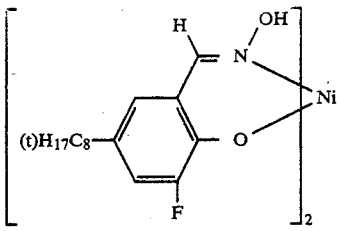
-continued
XI-24
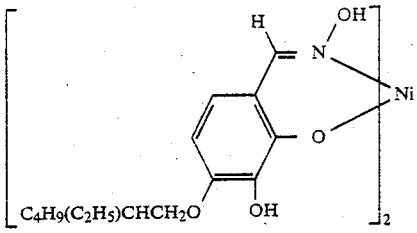
XI-25
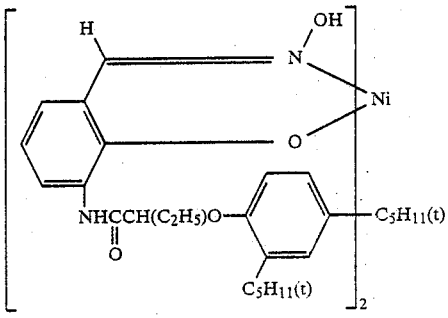
XI-26
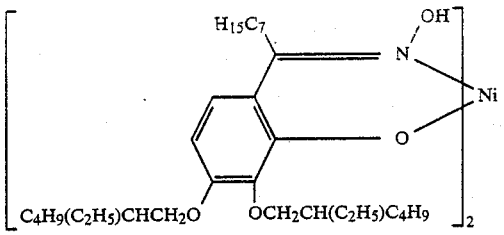
XI-27
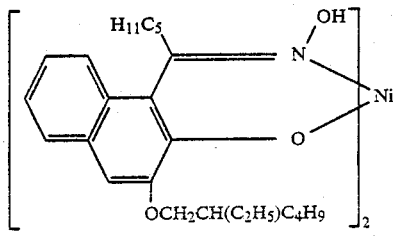
XI-28
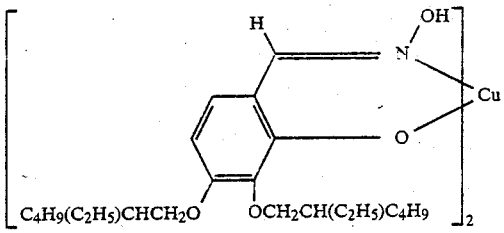
XI-29
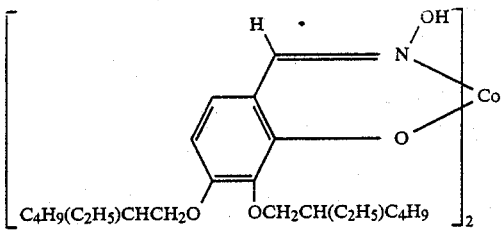

-continued
XI-30
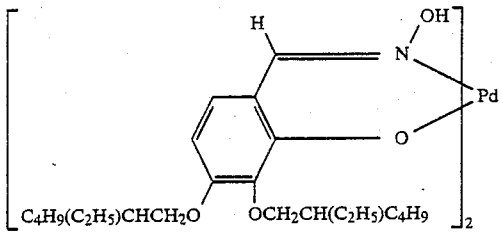
XI-31
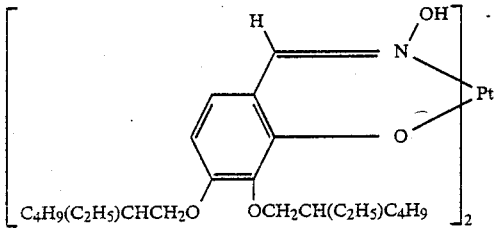
XI-32
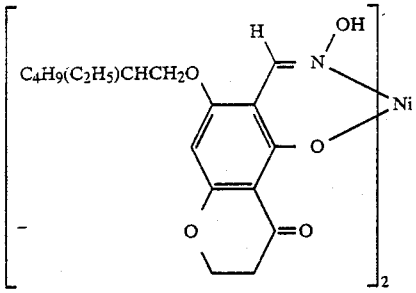
XI-33
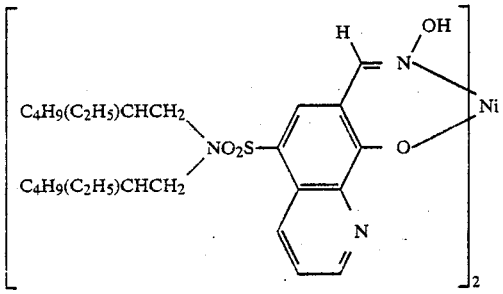
XI-34
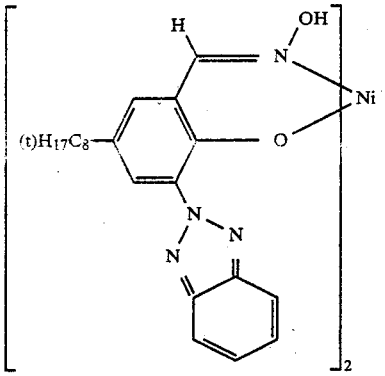
-continued
XI-35
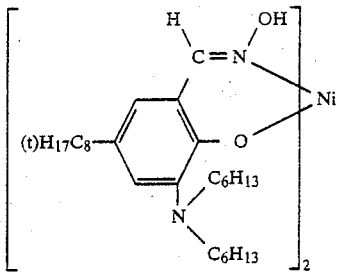
XI-36
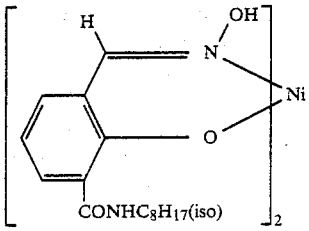
XI-37
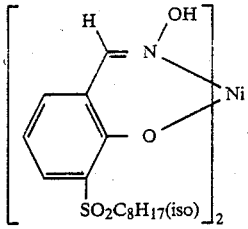
XI-38
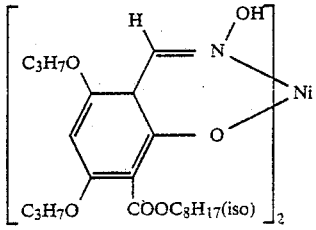
XI-39
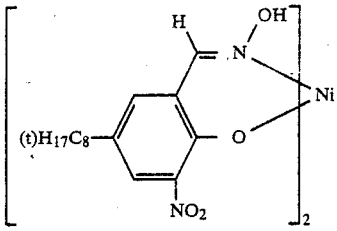
XI-40
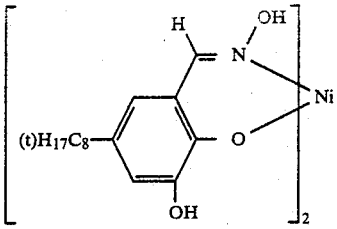

-continued
XI-41
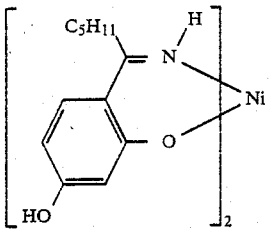
XI-42
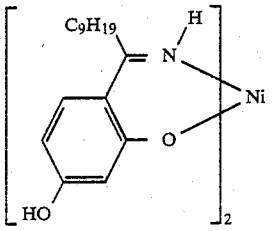
XI-43
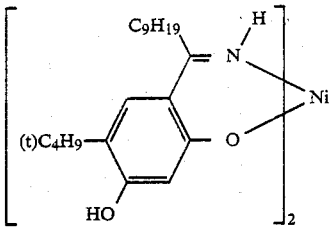
XI-44
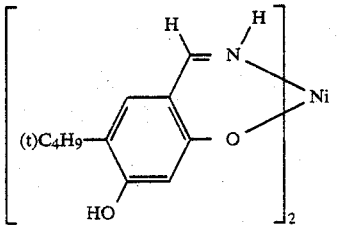
XI-45
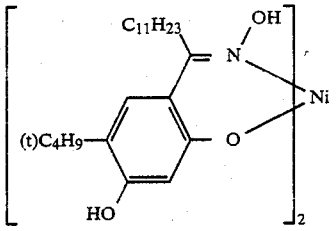
XI-46
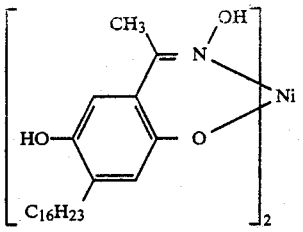
-continued
XI-47
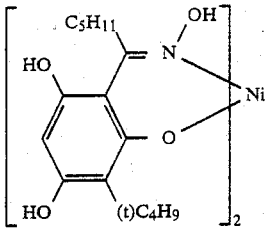
XI-48
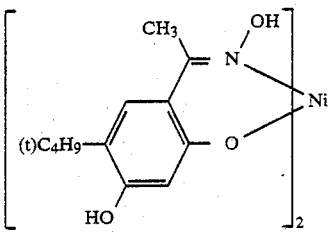
XI-49
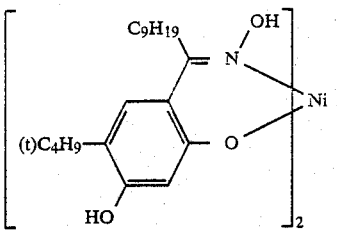
XI-50
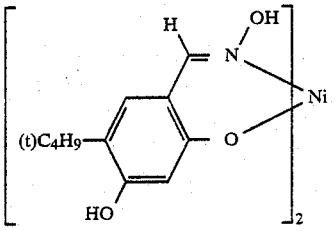
XI-51
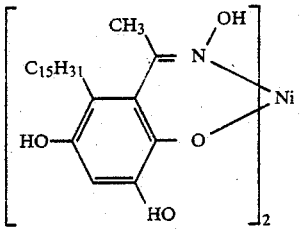
XI-52
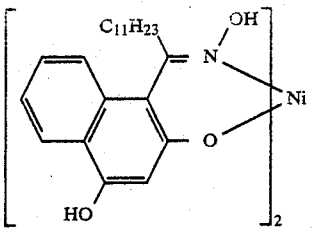

-continued
XI-53
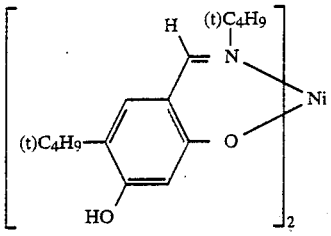
XI-54
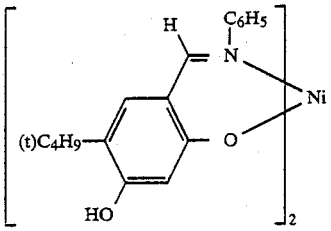
XI-55
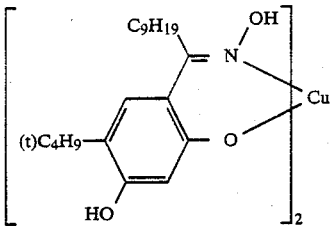
XI-56
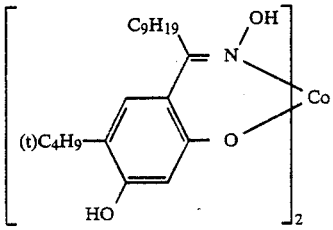
XI-57
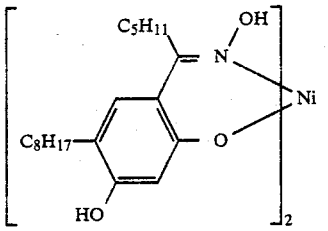
XI-58
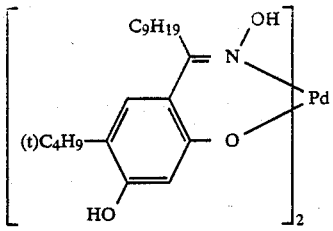
-continued
XI-59
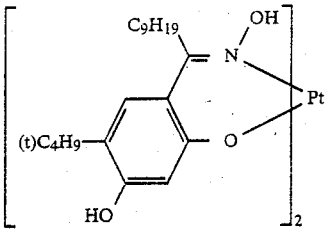
XI-60
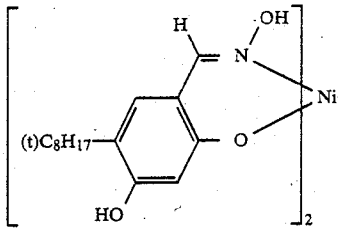
XI-61
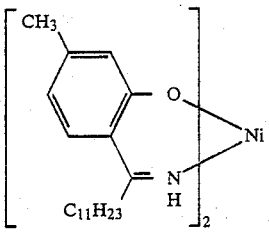
XI-62
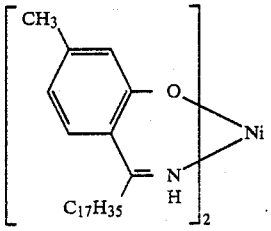
XI-63
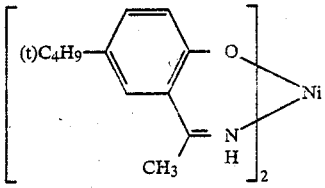
XI-64
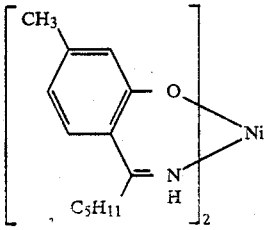
XI-65
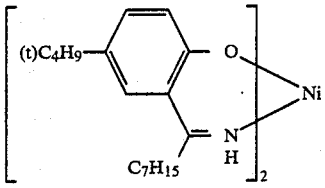

-continued
XI-66
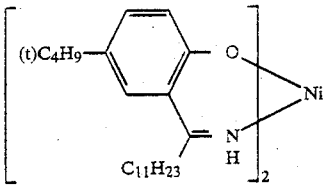
XI-67
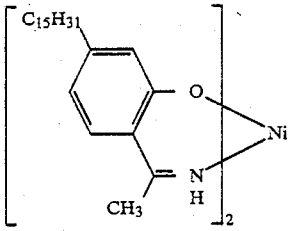
XI-68
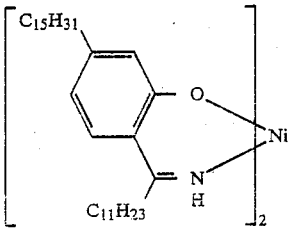
XI-69
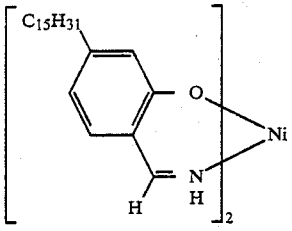
XI-70
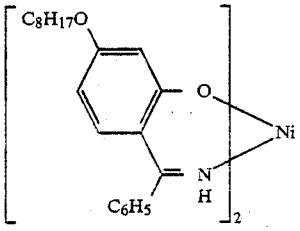
XI-71
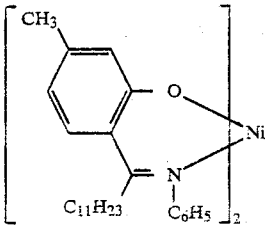
XI-72
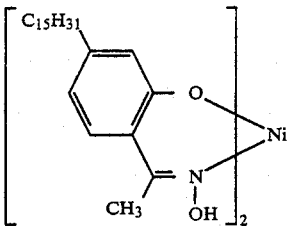
-continued
XI-73
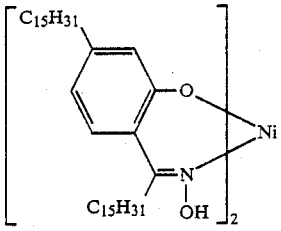
XI-74
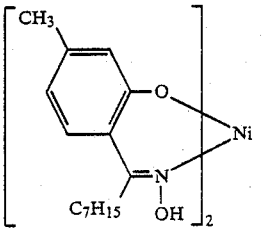
XI-75
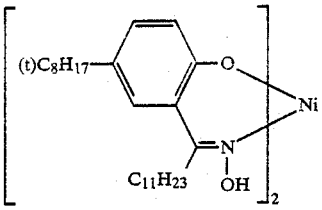
XI-76
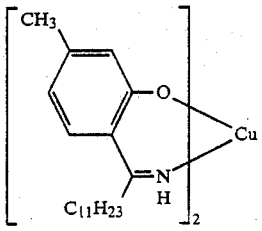
XI-77
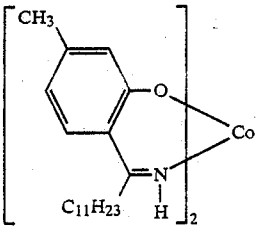
XI-78
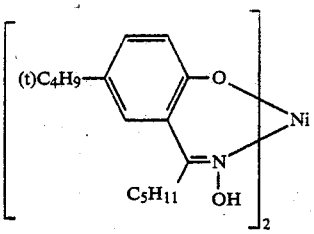

-continued
XI-79
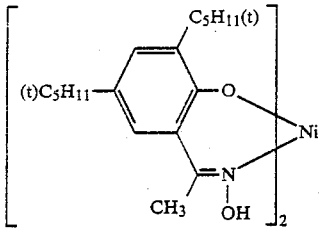
XI-80
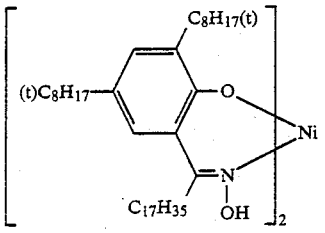
XI-81
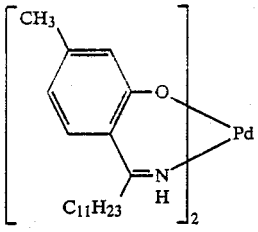
XI-82
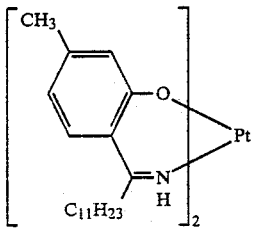
XI-83
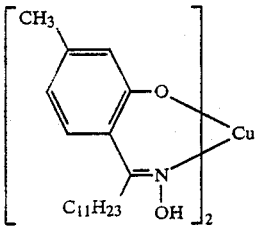
XI-84
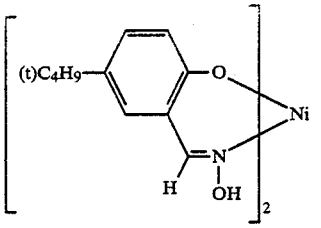
-continued
XI-85
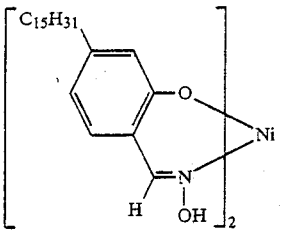
XI-86
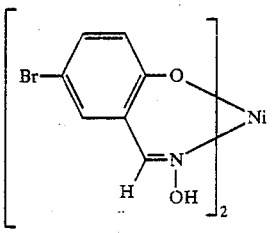
XI-87
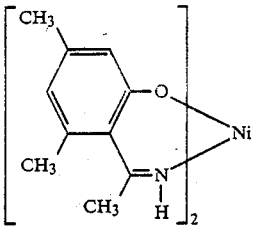
XI-88
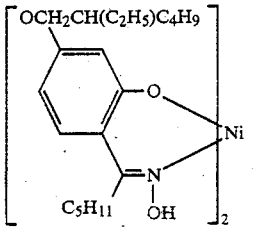
XI-89
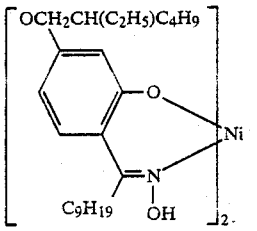
XI-90
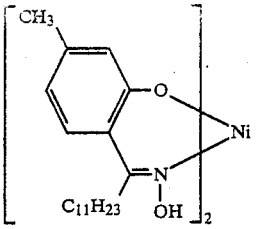

-continued
XI-91
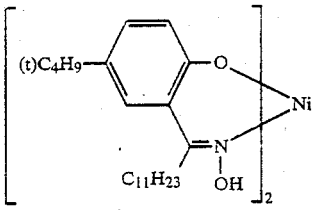
XI-92
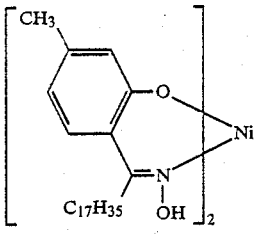
XI-93
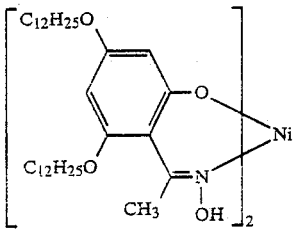
XI-94
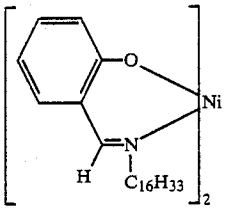
XI-95
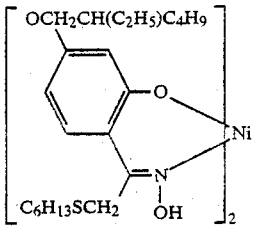
XI-96
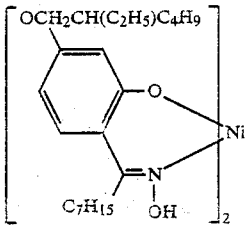
XI-97
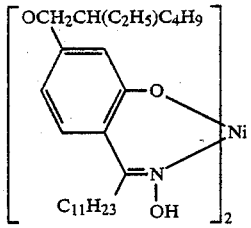
-continued
XI-98
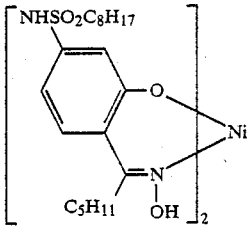
XI-99
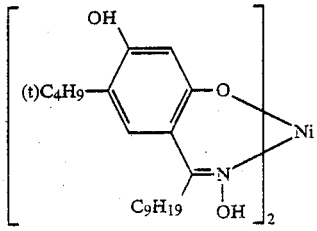
XI-100
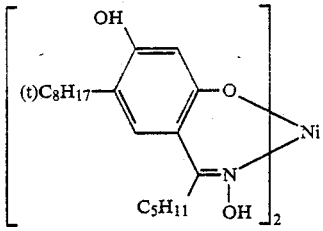
XI-101
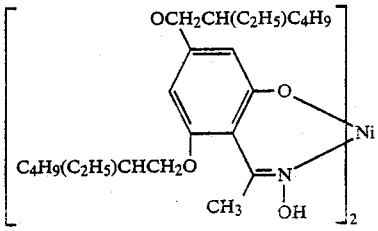
XI-102
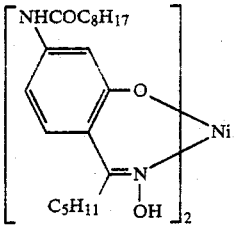
XI-103
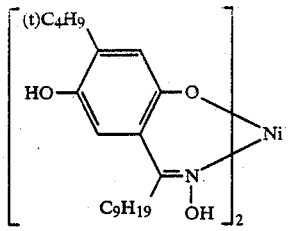

-continued

XI-104

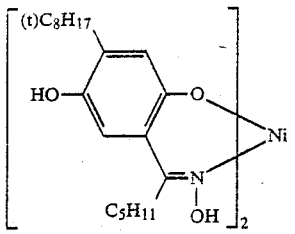

XI-105

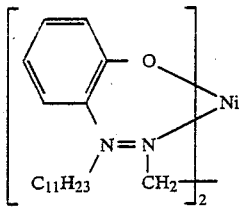

XI-106

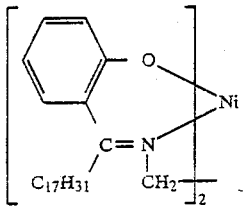

XI-107

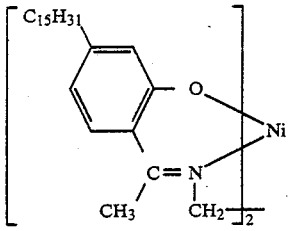

These complexes can be synthesized according to the method as disclosed in E. G. Cox, F. W. Pinkard, W. Wardlaw and K. C. Webster, J. Chem. Soc., 1935, p 459.

The complex according to the present invention may be used preferably at a proportion generally of 0.01 to 1 mole per mole of the coupler according to the present invention, more preferably at a proportion of 0.05 to 0.5 mole.

Also, it is preferred to use the complex according to the present invention and the coupler according to the present invention in the same layer, more preferably, to permit them to exist in the same oil droplet.

In the compound represented by the above formula (XXII), (XII)

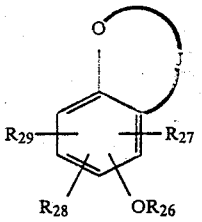

$R_{26}$ represents a hydrogen atom, an alkyl group (e.g. a methyl group, an ethyl group, a propyl group, an n-octyl group, a dodecyl group, a hexadecyl group, etc.), an acyl group (e.g. an acetyl group, a benzoyl group, a pentanoyl group, a (2,4-di-t-amylphenoxy)acetyl group, etc.), a sulfonyl group (e.g. a methanesulfonyl group, a butanesulfonyl group, a benzenesulfonyl group, a toluenesulfonyl group, a hexadecanesulfonyl group, etc.), a carbamoyl group (e.g. an N-methylcarbamoyl group, an N,N-diethylcarbamoyl group, an N-dodecylcarbamoyl group, an N-phenylcarbamoyl group, etc.), a sulfamoyl group (e.g. an N-methylsulfamoyl group, an N,N-dimethylsulfamoyl group, an N-tetradecylcarbamoyl group, an N-phenylsulfamoyl group, etc.), an alkoxycarbonyl group (e.g. methoxycarbonyl group, an ethoxycarbonyl group, a benzyloxycarbonyl group, a phenoxycarbonyl group, etc.), a trialkylsilyl group (e.g. a trimethylsilyl group, a dimethylbutylsilyl group, etc.) and the like, and J represents non-metallic atoms necessary for forming a 5- or 6-membered ring together with carbon atom and oxygen atom to be bonded thereto, and the ring may have a substituent such as an alkyl group (e.g., a methyl group, a t-butyl group, a cyclohexyl group, an octyl group, a dodecyl group, an octadecyl group, etc.), an alkoxy group (e.g. a methoxy group, a butoxy group, a dodecyl group, an oxy group, etc.), an aryl group (e.g. a phenyl group, etc.), an aryloxy group (e.g. a phenoxy group, etc.), an aralkoxy group (e.g. a benzyloxy group, a phenethyloxy group, etc.), an N-substituted amino group (e.g. an alkylamino group, a dialkylamino group, an N-alkyl-N-arylamino group, a piperazino group, etc.), a heterocyclic group (e.g. a benzothiazolyl group, a benzoxazolyl group, etc.), and the like and may be substituted by a residue which forms a fused ring. The above alkyl group and aryl group may have a substituent such as a halogen atom, a hydroxy group, a carboxy group, an alkoxycarbonyl group, an acyloxy group, a sulfo group, a sulfonyloxy group, an amide group (e.g. an acetamide group, an ethanesulfonamide group, a benzamide group, etc.), an alkoxy group, an aryloxy group and the like.

$R_{27}$, $R_{28}$ and $R_{29}$ each represent a hydrogen atom, an alkyl group (e.g. a methyl group, a t-butyl group, a cyclopentyl group, an n-octyl group, a t-octyl group, a dodecyl group, an octadecyl group, etc.), an alkoxy group (e.g. a methoxy group, a butoxy group, a dodecyloxy group, etc.), an aryl group (e.g. a phenyl group, etc.), an aryloxy group (e.g. a phenoxy group, etc. ), an aralkyl group (e.g. a benzyl group, a phenethyl group, etc.), an alkenyl group (e.g. an allyl group, etc.), an alkenoxy group (e.g. an allyloxy group, etc.), an acylamino group (e.g. an acetylamino group, a benzamide group, a (2,4-di-t-amylphenoxy)acetylamide group, etc.), a halogen atom (e.g. a chlorine atom, a bromine atom, etc.), an alkylthio group (e.g. an ethylthio group, a dodecylthio group, an octadecylthio group, etc.), a diacylamino group (e.g. a succinic imide group, a hydantoinyl group, etc. ), an arylthio group (e.g. a phenylthio group, etc. ), an alkoxycarbonyl group (e.g. a methoxycarbonyl group, an ethoxycarbonyl group, a benzyloxycarbonyl group, etc.), an acyloxy group (e.g. an acetyloxy group, a benzoyloxy group, etc.), an acyl group (e.g. a methylcarbonyl group, etc.), a sulfonamide group and the like. These groups represented by the $R_{27}$, $R_{28}$ and $R_{29}$ may be the same or different from each other.

In the compound represented by the formula (XII), a bisspiro compound are included therein, and the bisspiro compound to be preferably used in the present invention is a compound represented by the formula (XII'):

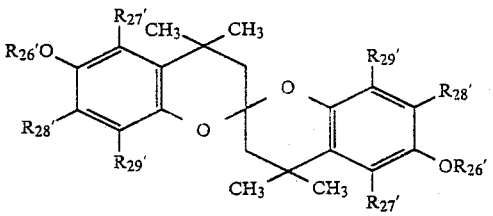

(XII')

In the formula (XII'), each of $R_{26}'$, $R_{27}'$, $R_{28}'$ and $R_{29}'$ has the same meanings as $R_{26}$, $R_{27}$, $R_{28}$ and $R_{29}$ in the formula (XII), respectively.

The compounds to be preferably used in the present invention are 5-hydroxycoumarans, 6-hydroxychromans and 6,6'-hydroxy-bis-2,2'-spirochromans.

More preferred compounds are 5-hydroxycoumarans, 6-hydroxychromans and 6,6'-hydroxy-bis-2,2'-spirochromans, where $R_{27}$, $R_{28}$, $R_{29}$, $R_{27}'$, $R_{28}'$ and $R_{29}'$ are a hydrogen atom or an alkyl group, and total carbon atoms of $R_{27}$, $R_{28}$ and $R_{29}$, or $R_{27}'$, $R_{28}'$ and $R_{29}'$ are 8 to 40.

In the compound represented by the formula (XIII),

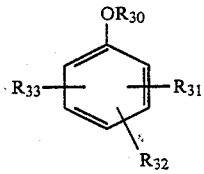

(XIII)

$R_{31}$, $R_{32}$ and $R_{33}$ each represent a hydrogen atom, a hydroxyl group, an alkyl group (e.g. a methyl group, an ethyl group, a t-butyl group, a t-octyl group, a t-propyl group, an n-octadecyl group, etc.), an alkenyl group (e.g. an allyl group, a 1-t-butyl-1-allyl group, etc.), an alkoxy group (e.g. a methoxy group, a hexyloxy group, an octoxy group, a benzyloxy group, etc.), an aryl group (e.g. a phenyl group, a naphthyl group, etc.), an aryloxy group (e.g. a phenyloxy group, etc.), an acyloxy group (e.g. an acetyloxy group, a benzoyloxy group, etc.), an alkoxycarbonyl group (e.g. a methoxycarbonyl group, an ethoxycarbonyl group, a benzyloxycarbonyl group, etc.), an alkylthio group (e.g. an octylthio group, etc.), an arylthio group (e.g. a phenylthio group, a p-hydroxylthio group, etc.) and the like, provided that total carbon atoms of $R_{31}$, $R_{32}$ and $R_{33}$ are 8 or more.

These groups represented by $R_{31}$, $R_{32}$ and $R_{33}$ may be the same or different from each other. $R_{30}$ has the same meaning as $R_{26}$ in the formula (XII).

Among the compound represented by (XIII) according to the present invention, a compound represented by the formula (XIII') is preferably used in the present invention.

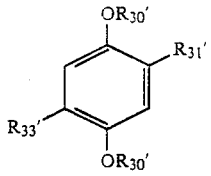

(XIII')

In the formula, $R_{30}'$, $R_{30}''$, $R_{31}'$ and $R_{33}'$ *have the same meanings as* $R_{30}$, $R_{31}$ and $R_{33}$ in the formula (XIII).

Further, the compounds where $R_{30}'$, $R_{30}''$, $R_{31}'$ and $R_{33}'$ are a hydrogen atom or an alkyl group and total carbon atoms of $R_{30}'$, $R_{31}'$ and $R_{33}'$ are 8 or more and 40 or less are more preferred.

In the compound represented by the formula (XIV) according to the present invention,

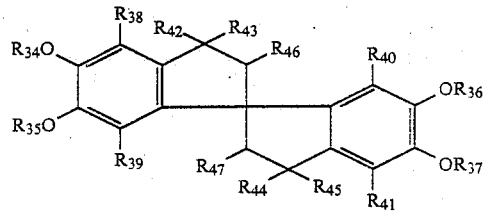

(XIV)

$R_{34}$, $R_{35}$, $R_{36}$ and $R_{37}$ each represent a hydrogen atom, an alkyl group (e.g., a methyl group, an ethyl group, a propyl group, an n-octyl group, an i-octyl group, etc.), an alkenyl group (e.g. an allyl group, an octenyl group, an oleyl group, etc.), an aryl group (e.g. a phenyl group, etc.), a heterocyclic group (e.g. a tetrahydropyranyl group, a pyrimidyl group, etc.), a $R_{48}$—CO— group, a $R_{49}$—$SO_2$— group or a $R_{50}$—NHCO— group.

Here, $R_{48}$, $R_{49}$ and $R_{50}$ each represent an alkyl group (e.g. a methyl group, an ethyl group, an n-propyl group, an n-butyl group, an n-octyl group, a benzyl group, etc.), an alkenyl group (e.g. an allyloctenyl group, an oleyl group, etc.), an aryl group (e.g. a phenyl group, a methoxyphenyl group, a naphthyl group, etc.) or a heterocyclic group (e.g. a pyridyl group, a pyrimidyl group, etc.).

$R_{38}$, $R_{39}$, $R_{40}$ and $R_{41}$ each represent a hydrogen atom, a halogen atom (e.g. a chlorine atom, a bromine atom, etc.), an alkyl group (e.g. a methyl group, an ethyl group, an n-butyl group, an n-octyl group, etc.), an alkenyl group (e.g. a hexenyl group, an octenyl group, an allyl group, etc.), an alkoxy group (e.g. a methoxy group, an ethoxy group, a benzyloxy group, etc.) or an alkenoxy group (e.g. a hexenyloxy group, etc.). These groups represented by the $R_{38}$, $R_{39}$, $R_{40}$ and $R_{41}$ may be the same or different from each other.

$R_{42}$, $R_{43}$, $R_{44}$, $R_{45}$, $R_{46}$ and $R_{47}$ each represent a hydrogen atom, an alkyl group (e.g. a methyl group, an ethyl group, an n-propyl group, an n-butyl group, a benzyl group, etc.), an alkenyl group (e.g. a hexenyl group, an octenyl group, etc.) or an aryl group (e.g. a phenyl group, a naphthyl group, etc.). These groups represented by the $R_{42}$, $R_{43}$, $R_{44}$, $R_{45}$, $R_{46}$ and $R_{47}$ may be the same or different from each other.

Among the compounds represented by the formula (XIV), preferred compounds are those where $R_{34}$, $R_{35}$, $R_{36}$, $R_{37}$, $R_{84}$, $R_{39}$, $R_{40}$, $R_{41}$, $R_{42}$, $R_{43}$, $R_{44}$ and $R_{45}$ are a hydrogen atom or an alkyl group and total carbon atoms thereof are 8 to 80.

Preferred examples of the compounds represented by the formula (XII), (XIII) and (XIV) are shown below, but the present invention is not limited by these compounds.
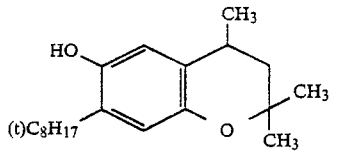
A-1
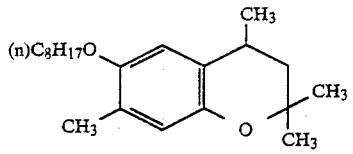
A-2
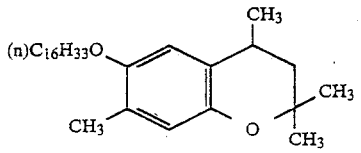
A-3
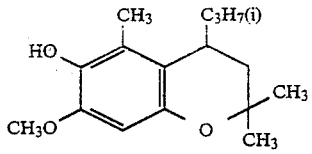
A-4
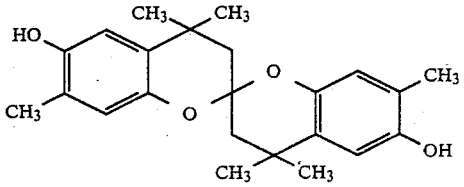
A-5
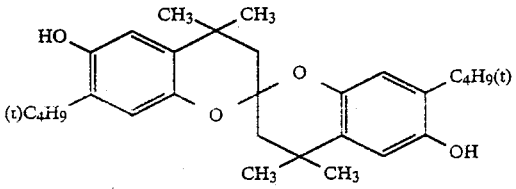
A-6
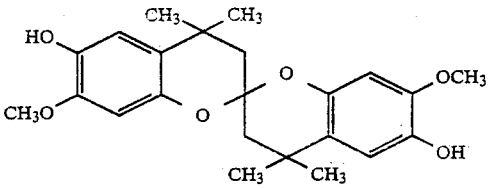
A-7
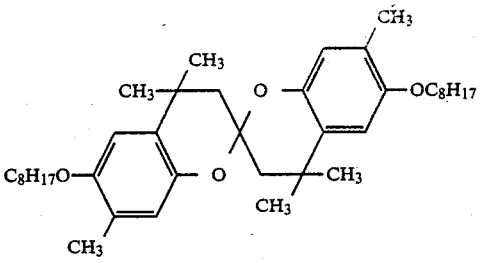
A-8

-continued
A-9
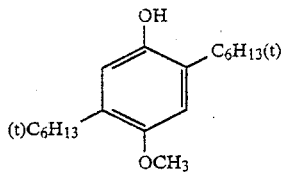
A-10
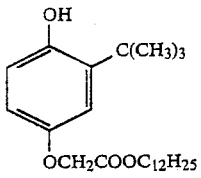
A-11
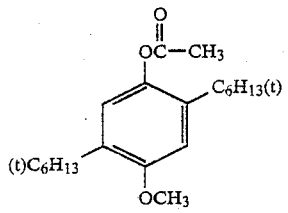
A-12
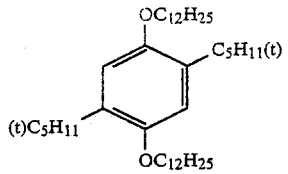
A-13
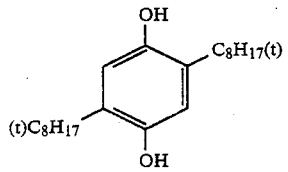
A-14
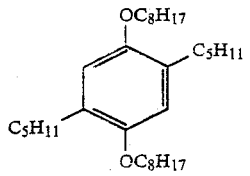
A-15
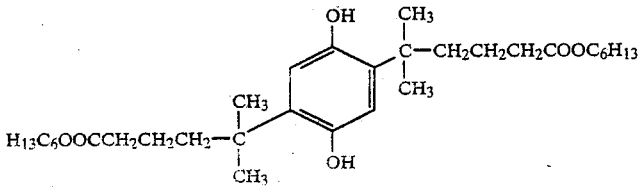
A-16
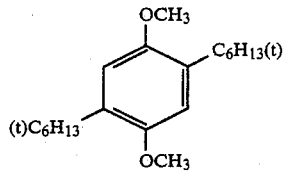

-continued
A-17
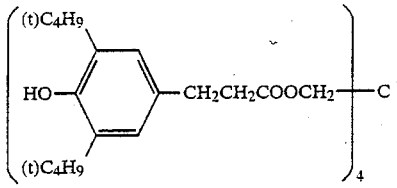
A-18
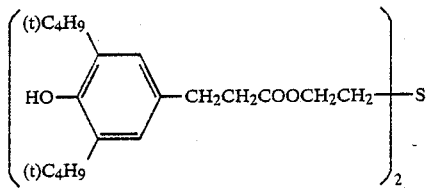
A-19
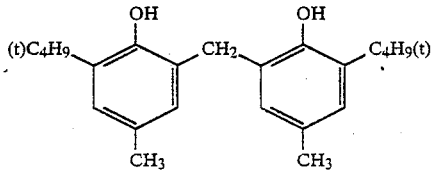
A-20
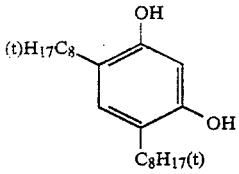
A-21
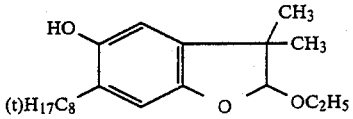
A-22
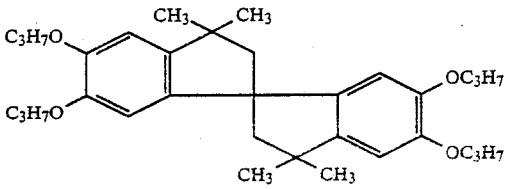
A-23
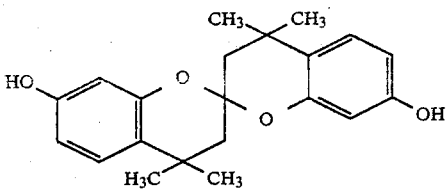
A-24
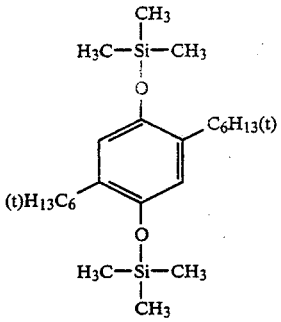

-continued
A-25
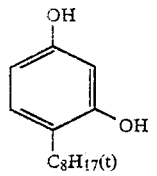
A-26
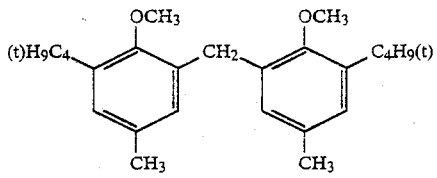
A-27
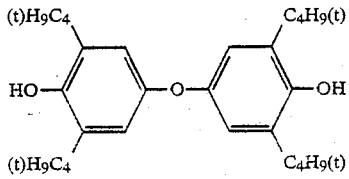
A-28
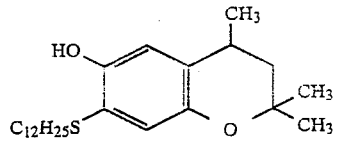
A-29
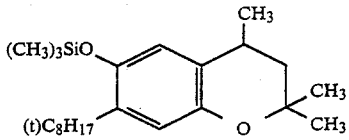
A-30
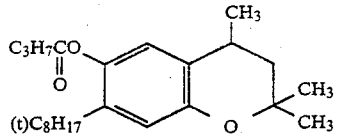
A-31
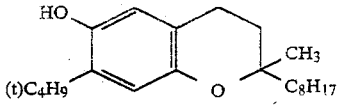
A-32
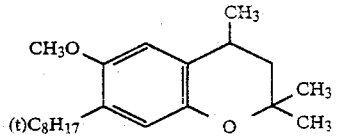
A-33
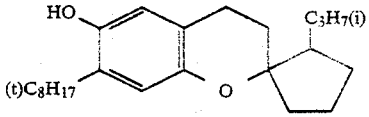
A-34
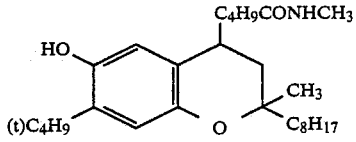

-continued
A-35
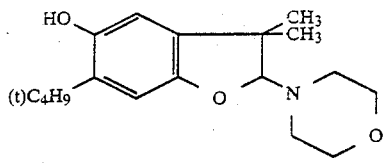
A-36
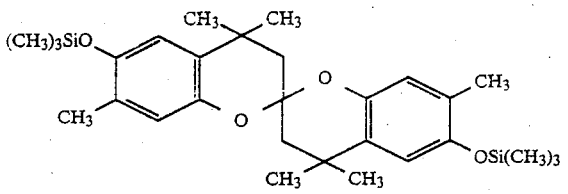
A-37
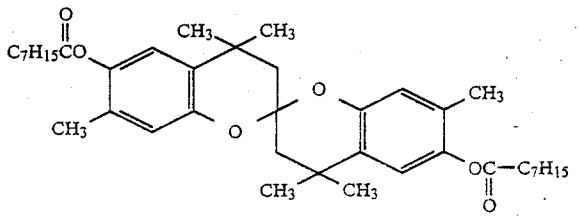
A-38
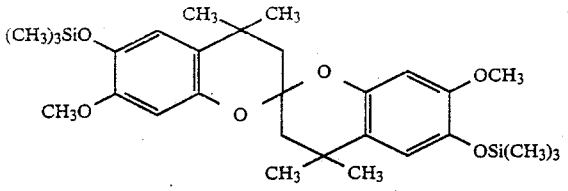
A-39
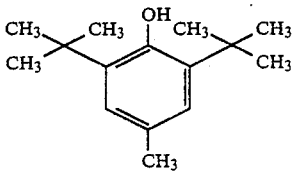
A-40
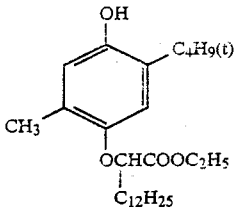
A-41
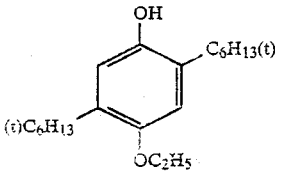
A-42
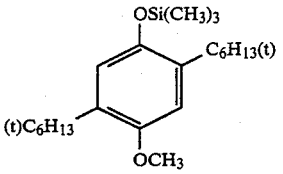

-continued
A-43
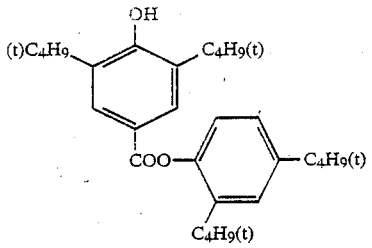
A-44
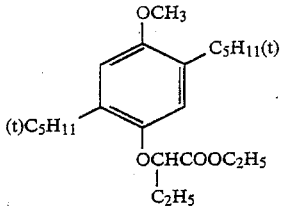
A-45
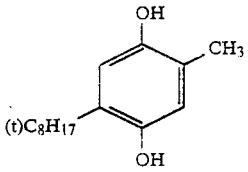
A-46
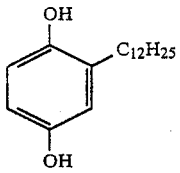
A-47
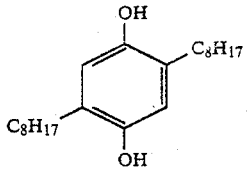
A-48
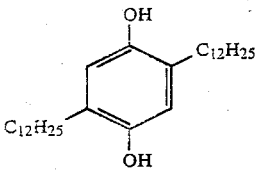
A-49
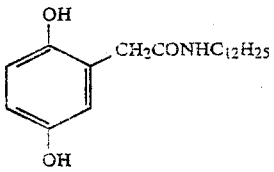
A-50
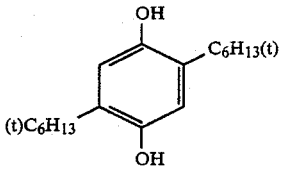

-continued
A-51
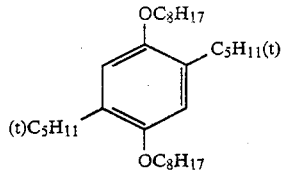
A-52
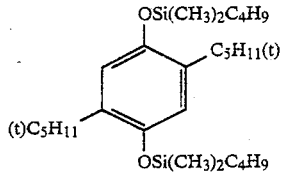
A-53
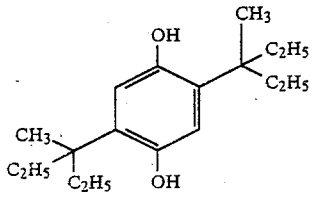
A-54
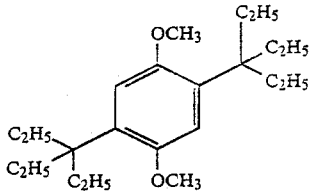
A-55
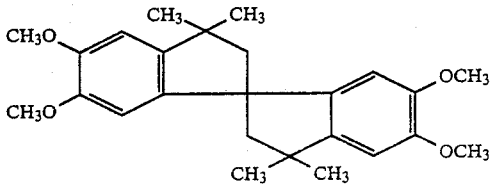
A-56
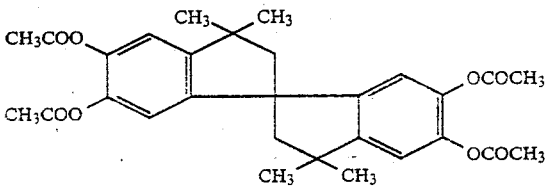
A-57
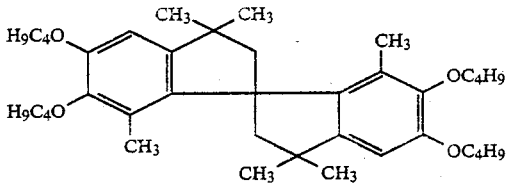
A-58
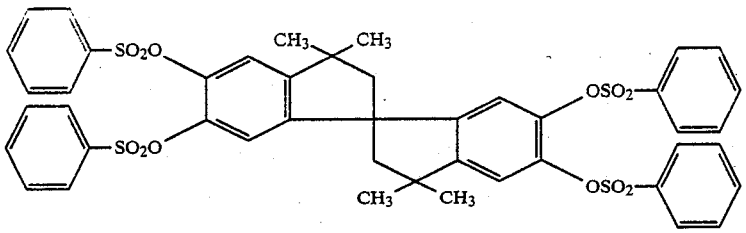

-continued
A-59
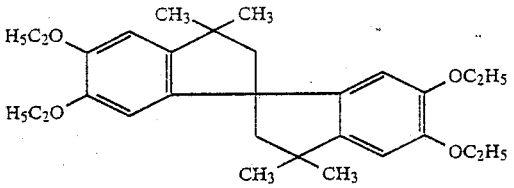
A-60
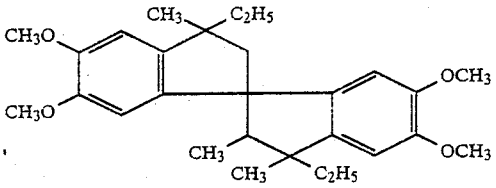
A-61
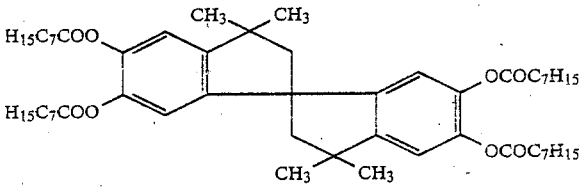
A-62
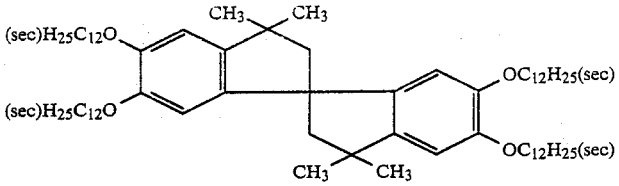
A-63
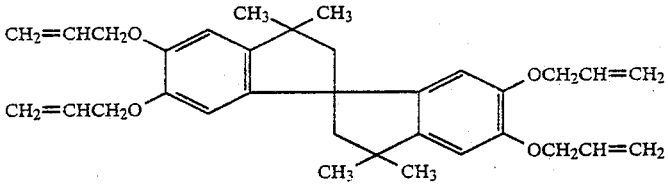
A-64
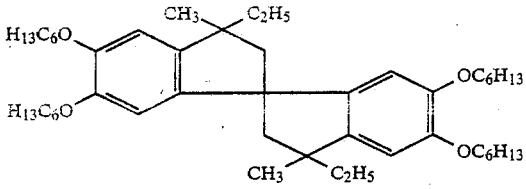
A-65
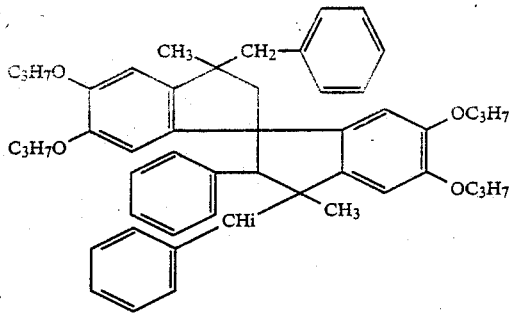

-continued
A-66
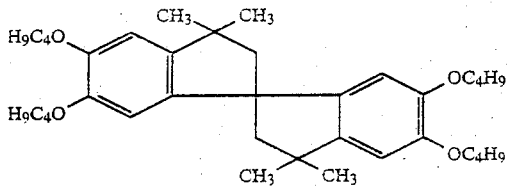
A-67
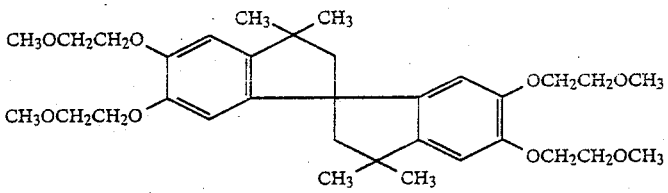
A-68
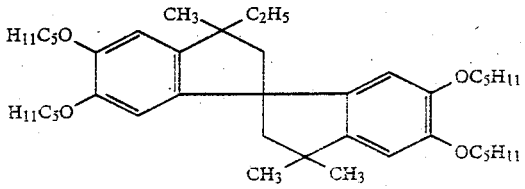
A-69
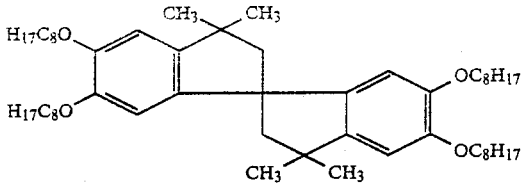
A-70
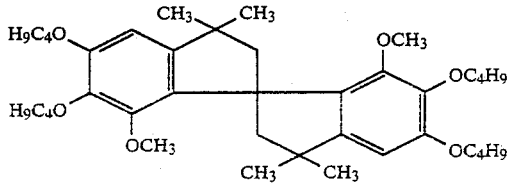
A-71
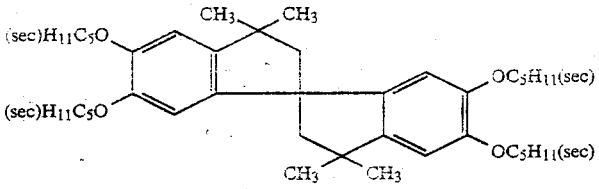
A-72
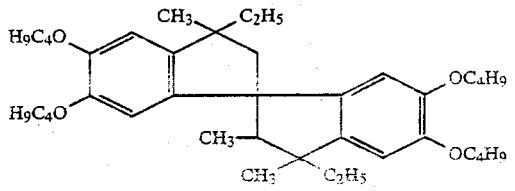
A-73
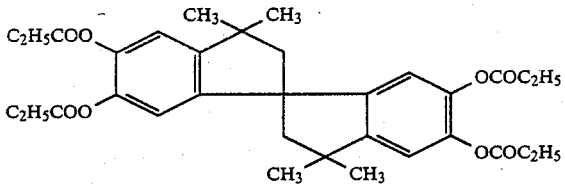

-continued
A-74
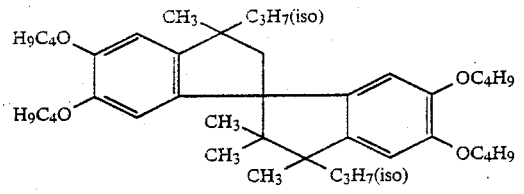
A-75
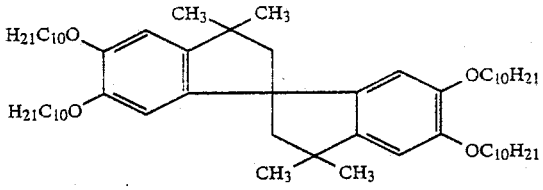
A-76
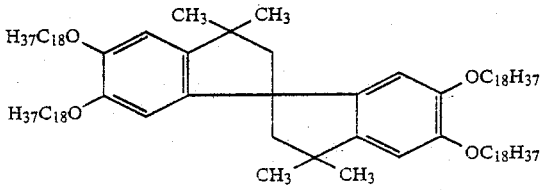
A-77
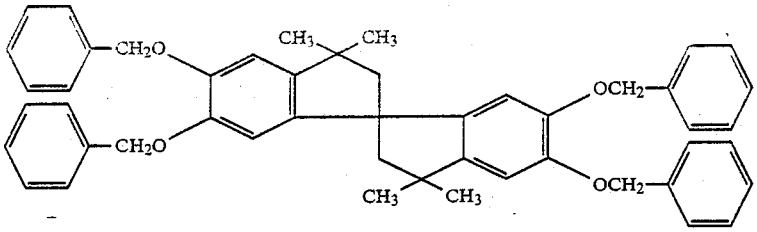
A-78
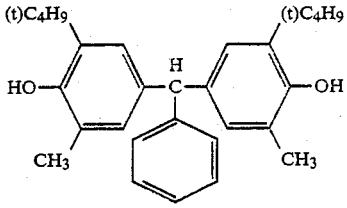
A-79
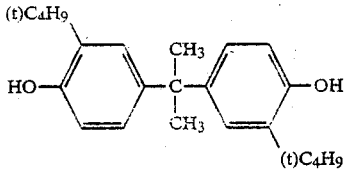
A-80
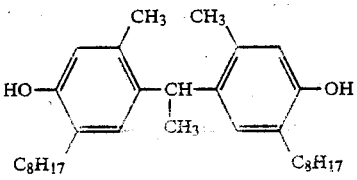
A-81
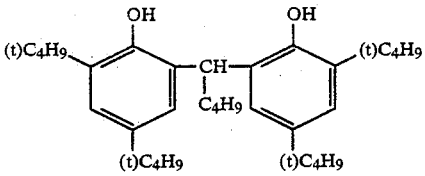

-continued

A-82

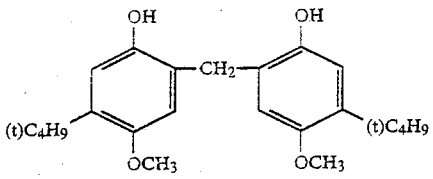

A-83

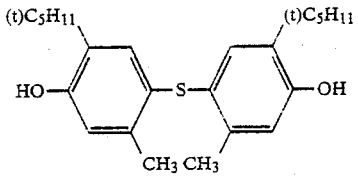

A-84

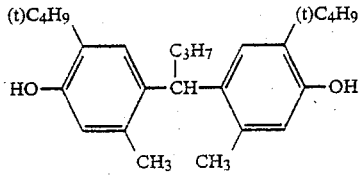

A-85

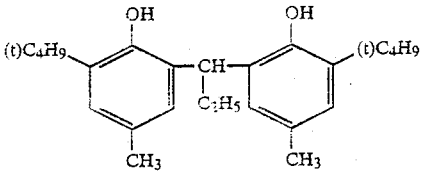

A-86

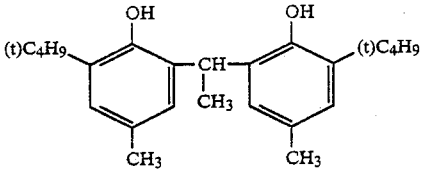

A-87

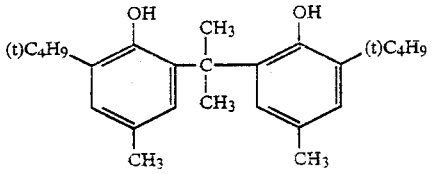

A-88

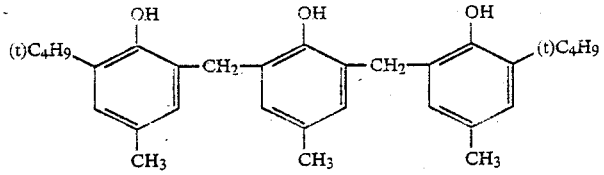

The compounds represented by the formulae (XII), (XIII) and (XIV) according to the present invention (hereinafter referred to an antioxidant according to the present invention) may be used preferably at a proportion of 0.01 to 1.0 mole, more preferably 0.1 to 0.4 mole per mole of the coupler.

As the method for dispersing the coupler, the metal complex and the antioxidant according to the present invention, there may be employed various methods such as the so-called alkali aqueous solution dispersing method, solid dispersing method, latex dispersing method, oil droplet-in-water type emulsifying method, etc., which methods can suitably be selected depending on the chemical structures of the coupler and the metal complex.

In the present invention, the latex dispersing method and the oil droplet-in-water type emulsifying method are particularly effective. These dispersing methods are well known in the art, and the latex dispersing method and its effects are described in Japanese Provisional Patent Publications No. 74538/1974, No. 59943/1976 and No. 32552/1979; and Research Disclosure, August 1976, No. 14,850, pp. 77–79.

Suitable latices comprise homopolymers, copolymers and terpolymers of monomers, including, for example, styrene, ethyl acrylate, n-butyl acrylate, n-butyl methacrylate, 2-acetoacetoxyethyl methacrylate, 2-(methacryloyloxy)ethyltrimethylammonium methosulfate, sodium 3-(methacryloyloxy)propane-1-sulfonate, N-isopropylacrylamide, N-[2-(2-methyl-4-oxypentyl)]acrylamide, 2-acrylamido-2-methylpropanesulfonic acid, etc. As the oil droplet-in-water emulsifying method, it is possible to apply the method known in the art in which a hydrophobic additive such as coupler is dispersed. For example, there is the method in which the above diffusion resistant coupler is dissolved in a high boiling point solvent and finely dispersed in a hydrophilic colloid such as gelatin.

The above high boiling point organic solvent may include esters such as phthalate, phosphate, etc., organic acid amides, ketones, hydrocarbon compounds, etc., but preferably high boiling organic solvents with a dielectric constant of 7.5 or less and 1.9 or more, having a vapor pressure of 0.5 mmHg or lower at 100° C. Useful high boiling point organic solvents may be exemplified by dibutyl phthalate, dioctyl phthalate, dinonyl phthalate, trioctyl phosphate, trinonyl phoshate, tricresyl phosphate, triphenyl phosphate, etc.

The light-sensitive silver photographic material of the present invention can be, for example, a negative or positive film for color as well as a color printing paper, and the effect of the present invention can be effectively exhibited when a color printing paper to be provided directly for viewing is employed.

The light-sensitive silver halide photographic material, typically the color printing paper, of the present invention may be either for single color or multi-color. In the case of a light-sensitive silver halide photographic material for multi-color, since the detractive color reproduction is effected, it has generally a structure having silver halide emulsion layers containing respective couplers of magenta, yellow and cyan as the colors for photography and non-light-sensitive layers laminated in an appropriate layer number and layer order on a support, and said layer number and layer order may appropriately be changed depending on the critical performance, purpose of use, etc.

The silver halide emulsion to be used in the light-sensitive silver halide photographic material of the present invention may include any of those conventionally used for silver halide emulsions such as silver bromide, silver iodobromide, silver chloroiodide, silver chlorobromide, silver chloride, etc.

The silver halide grains to be used in the silver halide emulsion of the present invention may be one obtained by either one of the acidic method, the neutral method or the ammoniacal method. Said grains may be grown at one time or grown after preparation of seed grains. The method for preparation of seed grains and the method for growth may be either the same or different.

The silver halide emulsion may be made either by mixing simultaneously halogen ions and silver ions or by mixing either one of them into the other. Also, while considering the critical growth speed of silver halide crystals, it may be formed by adding halide ions and silver ions successively at the same time while controlling pH and pAg in the mixing vessel. After growth, the halogen composition of the grains may be changed by use of the conversion method.

In preparation of the silver halide emulsion of the present invention, by use of a silver halide solvent if desired, the grains size, the grain shape, the grain size distribution and the grain growth speed of the silver halide grains can be controlled.

The silver halide grains to be used in the silver halide emulsion of the present invention can be added with metal ions by use of cadmium salts, zinc salts, lead salts, thallium salts, iridium salts or complexes, rhodium salts or complexes, iron salts or complexes to include them internally within and/or on the surfaces of the grains, or may be placed in an appropriate reducing atmosphere thereby to impart reducing sensitizing nuclei to the grains internally therein and/or on the surfaces thereof.

In the silver halide emulsion of the present invention, unnecessary soluble salts may be eliminated or contained as such after completion of the growth of the silver halide grains. When said salts are to be removed, it can be practiced on the basis of the method as disclosed in Research Disclosure No. 17643.

The silver halide grains to be used in the silver halide emulsion of the present invention may consist of uniform layers of the inner portion and the surface or alternatively different layers.

The silver halide grains to be used in the silver halide emulsion of the present invention may be grains of the type in which latent images are formed primarily on the surfaces, or of the type in which they are formed primarily within the inner portions of the grains.

The silver halide emulsion of the present invention can be chemically sensitized in a conventional manner. That is, it is possible to use the sulfur sensitization method employing a sulfur compound capable of reacting with silver ions or active gelatin, the selenium sensitization method employing a selenium compound, the reducing sensitization method employing a reducible substance and the noble metal sensitization employing gold or other noble metal compounds, either singly or in combination.

The silver halide emulsion of the present invention can be sensitized optically to a desired wavelength region by use of dyes known as sensitizing dyes in the field of photography. The sensitizing dye may be used either singly or in combination of two or more compounds. It is also possible to incorporate in the emulsion a potentiating sensitizer which is a dye having itself no spectral sensitizing action or a compound which does not substantially asbsorp visible light, but can strengthen the sensitizing action of a sensitizing dye.

In the silver halide emulsion of the present invention, compounds known as antifoggants or stabilizers in the field of photography may be added in the steps for preparation of light-sensitive materials, during storage or during chemical aging for the purpose of preventing fogging during photographic processings and/or maintaining photographic performances stably, and/or on and/or after completion of chemical aging or before coating of the silver halide emulsion.

As the binder (or protective colloid) for the silver halide emulsion of the present invention, gelatin may be advantageously used. Otherwise, hydrophilic colloids such as gelatin derivatives, graft polymers of gelatin and other polymer, proteins, cellulose derivatives, synthetic hydrophilic polymeric materials such as homo- or copolymers can also be used.

The photographic emulsion layer or other hydrophilic colloid layers in the light-sensitive material employing the silver halide emulsion of the present invention is hardened by crosslinking the binder (or protective colloid) molecules and using singly or in combination with film hardening agents for enhancing film strength. The film hardening agent should desirably be added in an amount capable of hardening the light-sensitive material to the extent of requiring no addition of a film hardening agent into processing solutions, but it is also possible to add a film hardening agent in a processing solution.

For the purpose of enhancing flexibility of the silver halide emulsion layer and/or other hydrophilic layers in the light-sensitive material employing the silver halide emulsion of the present invention, a plasticizer may be added.

For the purpose of improving dimensional stability of the photographic emulsion layer or other hydrophilic colloid layers in the light-sensitive material employing the silver halide emulsion of the present invention, a dispersion of a water-insoluble or difficultly soluble synthetic polymer (latex) may be contained therein.

In the emulsion layer of the light-sensitive silver halide color photographic material of the present invention, in the color forming development processing, there is employed a dye forming coupler capable of forming a dye through the coupling reaction with the oxidized product of an aromatic primary amine developer (e.g. p-phenylenediamine derivative, aminophenol derivative, etc.). Said dye forming coupler is commonly selected so that a dye capable of absorbing the light-sensitive spectral light in the emulsion layer may be formed for each emulsion layer, and a yellow dye forming coupler is used in the blue-sensitive emulsion layer, a magenta dye forming coupler in the green-sensitive emulsion layer and a cyan dye forming coupler in the red-sensitive emulsion layer. However, depending on the purpose, a light-sensitive silver halide color photographic material may be prepared in a manner different from the above combination.

It is also possible to incorporate a UV-absorber for prevention of fogging and deterioration of images by UV-ray due to discharging caused by charging of the hydrophilic colloid layers such as protective layer, intermediate layer, etc. in the light-sensitive material of the present invention.

In the color light-sensitive material employing the silver halide emulsion of the present invention, there may also be provided auxiliary layers such as filter layer, halation preventive layer and/or irradiation preventive layer, etc. In these layers and/or emulsion layers, dyes which are flowed out from the color light-sensitive material or bleached during development processing may be contained.

For the purpose of enhancing writability to reduce the luster of the light-sensitive material or prevention of sticking between the light-sensitive materials, a matting agent may be added in the silver halide emulsion layers and/or other hydrophilic colloid layers used in the light-sensitive silver halide material employing the silver halide emulsion of the present invention.

A lubricant may also be added for the purpose of reducing the slide friction of the light-sensitive material employing the silver halide emulsion of the present invention.

In the light-sensitive material employing the silver halide emulsion of the present invention, there may be added an antistatic agent for prevention of charging. The antistatic agent may be used in the charge prevention layer on the side of the support where no emulsion is laminated or alternatively in the emulsion layer and/or the protective colloid layer other than emulsion layers on the side where emulsion layers are laminated relative to the support.

In the photographic emulsion layer and/or other hydrophilic coloid layers in the light-sensitive material employing the silver halide emulsion of the present invention, various surfactants may be used for the purpose of improvement of coating characteristic, prevention of charging, improvement of slidability, emulsification, prevention of adhesion and improvement of photographic characteristics (promotion of development, hardening of tone, sensitization, etc.).

In the light-sensitive material employing the silver halide emulsion of the present invention, the photographic emulsion layer or other layers may be coated onto a flexible reflective support such as a paper having baryta layer or α-olefin polymer laminated thereon, or a synthetic paper, etc. a film comprising a semi-synthetic or synthetic polymer such as cellulose acetate, cellulose nitrate, polystyrene, polyvinyl chloride, polyethylene terephthalate, polycarbonate, polyamide, etc. or a rigid material such as glass, metal, earthenware, etc.

The silver halide material of the present invention may be applied directly on the support surface, after application of corona discharging, UV-ray irradiation or flame treatment, etc., if desired, or through an intermediary one or more subbing layer for improvement of adhesiveness, charging prevention, dimensional stability, abrasion resistance, hardness, halation prevention, frictional characteristic and/or other characteristics.

At a coating of the light-sensitive photographic material using a silver halide emulsion of the present invention, a thickener may be used in order to improve the coating ability. As the method for coating, particularly useful are the extrusion coating which can simultaneously coat two or more layers and the curtain coating.

The light-sensitive material of the present invention can be exposed by use of an electromagnmagnetic wave in the spectral region to which the emulsion layer constituting the light-sensitive material of the present invention has sensitivity. As the light source, there may be employed any of the known light sources suchas natural light (sunlight), tungsten lamp, fluorescent lamp, mercury lamp, xenon arc lamp, carbon arc lamp, xenon flash lamp, cathode ray tube flying spot, various laser beams, emission diode light, electron beam, X-ray, light emitted from a fluorescent material excited by γ-ray, α-ray, etc.

The exposure time may be an exposure time from 1 millisecond to one second conventionally used in cameras, as a matter of course, or even shorter than 1 millisecond, for example, exposure for 100 microseconds to 1 microsecond. Also, exposure for longer than one seconds is possible. Said exposure may be effected either continuously or intermittently.

The light-sensitive silver halide photographic material of the present invention is capable of forming an image by carrying out color development known in this field of the art.

The aromatic primary amine color developing agent to be used in the color developing solution in the present invention may include known one used widely in various color photographic processes. These developing agents include aminophenol type and p-phenylenediamine type derivatives. These compounds are used generally in the form of salts, for example, hydrochlorides or sulfates, for the sake of stability, rather than in the free state. Also, these compounds may be used at concentrations generally of about 0.1 g to about 30 g, per liter of the color developing solution, preferably of about 1 g to about 1.5 g per liter of the color developing solution.

The aminophenol type developing solution may contain, for example, o-aminophenol, p-aminophenol, 5-amino-2-oxytoluene, 2-amino-3-oxytoluene, 2-oxy-3-amino -1,4-dimethylbenzene and the like.

Particularly useful primary aromatic amino type color developing agents are N,N'-dialkyl-p-phenylenediamine type compounds, of which alkyl group and phenyl group may be substituted by any desired substituent. Among them, examples of particularly useful compounds may include N,N'-diethyl-p-phenylenediamine hydrochloride, N-methyl-p-phenylenediamine hydrochloride, N,N'-dimethyl-p-phenylenediamine hydrochloride, 2-amino-5-(N-ethyl-N-dodecylamino)-toluene, N-ethyl-N-β-methanesulfonamidoethyl-3-methyl-4-aminoaniline sulfate, N-ethyl-N-β-hydroxyethylaminoaniline, 4-amino-3-methyl-N,N'-diethylaniline, 4-amino-N-(2-methoxyethyl)-N-ethyl-3-methylaniline-p-toluenesulfonate and the like.

In the color developing solution to be used in the processing of the present invention, in addition to the above primary aromatic amine type color developing agent, it is also possible to incorporate an alkali agent such as sodium hydroxide, sodium carbonate, potassium carbonate and the like, an alkali metal sulfite, an alkali metal bisulfite, an alkali metal thiocyanate, an alkali metal halide, benzyl alcohol, a water softening agent and a thickening agent, etc., as desired. The pH value of the color developing solution is usually 7 or higher, most commonly about 10 to about 13.

In the present invention, after color developing processing, processing with a processing solution having fixing ability is performed. When the processing solution having said fixing ability is a fixing solution, bleaching processing is performed prior thereto. As the bleaching agent to be used in said bleaching step, a metal complex of an organic acid may be used, and said metal complex has the action of color forming the non-color formed portion of the color forming agent simultaneously with oxidizing the metal salt to return it to silver halide, its constitution comprising an organic acid such as aminopolycarboxylic acid or oxalic acid, citric acid, etc. coordinated with metal ions such as of iron, cobalt, copper, etc. The most preferred organic acid for formation of such a metal complex of an organic acid may include polycarboxylic acids or aminopolycarboxylic acids. These polycarboxylic acids or aminopolycarboxylic acids may be alkali metal salts, ammonium salts or water-soluble amine salts.

Typical examples of these are enumerated below.

[I] Ethylenediaminetetraacetic acid
[II] Nitrilotriacetic acid
[III] Iminodiacetic acid
[IV] Disodium ethylenediaminetetraacetate
[V] Tetra(trimethylammonium) ethylenediaminetetraacetate
[VI] Tetrasodium ethylenediaminetetraacetate
]VII] Sodium nitrilotriacetate The bleaching agent used may contain a metal complex of an organic acid as described above as the bleaching agent together with various additives. As such additives, it is particularly desirable to incorporate a rehalogenating agent such as an alkali halide or an ammonium halide, for example, potassium bromide, sodium bromide, sodium chloride, ammonium bromide, etc., a metal salt, a chelating agent. Also, those known to be added conventionally into the bleaching solution, including pH buffering agents such as borates, oxalates, acetates, carbonates, phosphates, etc., alkylamines, polyethyleneoxides, etc.

Further, the fixing solution and the bleach-fixing solution may also contain pH buffering agents comprising sulfites such as ammonium sulfite, potassium sulfite, ammonium bisulfite, potassium bisulfite, sodium bisulfite, ammonium metabisulfite, potassium metabisulfite, sodium metabisulfite, etc., or various salts such as boric acid, borax, sodium hydroxide, potassium hydroxide, sodium carbonate, potassium carbonate, sodium bisulfite, sodium bicarbonate, potassium bicarbonate, acetic acid, sodium acetate, ammonium hydroxide, etc. either singly or as a combination of two or more compounds.

When the processing of the present invention is performed, while supplementing a bleach-fixing supplemental agent into the bleach-fixing solution (bath), said bleach-fixing solution (bath may contain a thiosulfate, a thiocyanate or a sulfite, etc., or these salts may be contained in said bleach-fixing supplemental solution and supplemented to the processing bath.

In the present invention, for enhancing the activity of the bleach-fixing solution, blowing of air or oxygen may be effected if desired into the bleach-fixing bath and the storage tank for the bleach-fixing supplemental solution, or a suitable oxidizing agent such as hydrogen peroxide, a hydrobromic acid salt, a persulfate, etc. may adequately be added.

The present invention is described in more detail by referring to the following Examples, by which the embodiments of the present invention are not limited at all.

EXAMPLE 1

A solution of 40 g of the above exemplary magenta coupler 7 in a solvent mixture of 30 ml of trioctyl phthalate and 100 ml of ethyl acetate was added to 300 ml of a 5% aqueous gelatin solution containing sodium dodecylbenzenesulfonate, followed by dispersing by means of a homogenizer. The resultant dispersion was mixed with 500 g of a green-sensitive silver chlorobromide emulsion (containing 30 g of silver) and a coating aid was added thereto to prepare a coating solution. Subsequently, the coating solution was applied on a polyethylene-coated paper support, and further a coating solution containing 2-(2'-hydroxy-3',5'-di-t-amylbenzotriazole), gelatin, an extender and a film hardener was provided by coating to give a protective film. During this operation, the amount of 2-(2'-hydroxy-3',5'-di-t-amyl-benzotriazole) was made 5 mg/dm$^2$ and that of gelatin 15 mg/dm$^2$ to prepare a light-sensitive silver halide photographic material, which is called Sample 1 (Comparative).

Next, Samples 2 to 9 were prepared in the same manner as preparation of Sample 1 except for adding compounds according to the present invention in combinations as indicated in Table 1 to the emulsion layer of Sample 1.

These samples were subjected to optical wedge exposure by means of a sensitometer (Model KS-7, produced by Konishiroku Photo Industry K. K.), followed by the processing shown below.

| | Standard processing steps | Processing temperature | Processing time |
|---|---|---|---|
| [1] | Color developing | 38° C. | 3 min. 30 sec. |
| [2] | Bleach-fixing | 33° C. | 1 min. 30 sec. |
| [3] | Water washing | 25 to 30° C. | 3 min. |
| [4] | Drying | 75 to 80° C. | about 2 min. |

Compositions of processing solutions used in the above processing steps are as follows:

| | |
|---|---|
| (Color developing tank solution) | |
| Benzyl alcohol | 15 ml |
| Ethylene glycol | 15 ml |
| Potassium sulfite | 2.0 g |
| Sodium bromide | 0.7 g |
| Sodium chloride | 0.2 g |
| Potassium carbonate | 30.0 g |
| Hydroxylamine sulfate | 3.0 g |
| Tripolyphosphoric acid (TPPS) | 2.5 g |
| 3-Methyl-4-amino-N—(β-methanesulfonamidoethyl)aniline sulfate | 5.5 g |
| Fluorescent bleaching agent (4,4'-Diaminostilbenzsulfonic acid derivative) | 1.0 g |
| Potassium hydroxide | 2.0 g |
| (made up to a total quantity of one liter with addition of water, and adjusted to pH 10.20). | |
| (Bleach-fixing tank solution) | |
| Ferric ammonium ethylenediaminetetraacetate dihydrate | 60 g |
| Ethylenediaminetetraacetic acid | 3 g |
| Ammonium thiosulfate (70% solution) | 100 ml |
| Ammonium sulfite (40% solution) | 27.5 ml |
| Anhydrous sodium sulfite | 2.7 g |
| (adjusted to pH 7.1 with potassium carbonate or glacial acetic acid and made up to a total quantity of one liter with addition of water). | |

After processing, light-resistance and color change due to heat and temperature of each magenta dye image obtained was measured in the following manner.

Light-resistance Test

The fading percentage. ($\{[D_M^0-D]/D_M^0\}\times 100$; $D_M^0$: initial magenta density (1.0), $D_M$: magenta density after fading) was measured when the dye image formed on each sample was exposed to the sunlight by use of Underglass outdoor exposure stand for 30 days.

Heat-humidity Fading Test

Each samples formed the dye image were stored in a thermostatic oven maintaining at a temperature of 70° C. and a relative humidity of 80% for 7 days. Then, magenta densities ($D_M^0$ and $D_M$), cyan densities ($D_C^0$ and $D_C$) and yellow densities ($D_Y0$ and $D_Y$) at before and after storage at a portion of an initial green-light reflective density with 1.0 were measured and calculated the bluing degree ($\{[D_C/D_M]/[D_C^0/D_M^0]\}\times 100$: fading degree to blue color) and the redding degree ($\{[D_Y/D_M]/[D_Y^0/D_M^0]\}\times 100$: fading degree to red color).

These results are shown in Table 1.

TABLE 1

| | Sample No. | Metal complex | Anti-oxidant | Color fading (%) | Bluing degree | Redding degree |
|---|---|---|---|---|---|---|
| 1 | (Comparative) | — | — | 97 | 158 | 102 |
| 2 | (Comparative) | XI-1 (0.5) | — | 75 | 149 | 101 |
| 3 | (Comparative) | XI-96 (0.5) | — | 68 | 148 | 102 |
| 4 | (Comparative) | — | A-18 (0.5) | 85 | 141 | 102 |
| 5 | (Comparative) | — | A-26 (0.5) | 86 | 139 | 103 |
| 6 | (This invention) | XI-1 (0.5) | A-18 (0.5) | 42 | 117 | 102 |
| 7 | (This invention) | XI-1 (0.5) | A-26 (0.5) | 40 | 116 | 101 |
| 8 | (This invention) | XI-96 (0.5) | A-18 (0.5) | 43 | 119 | 100 |
| 9 | (This invention) | XI-96 (0.5) | A-26 (0.5) | 44 | 114 | 102 |

The numerical values in the brackets indicate molar ratios relative to a mole of the coupler.

Larger color fading shows worse light-resistance, and 100 in the bluing degree or redding degree means no color change and the value larger than 100 means occurance of color change to blue color or red color is large.

As apparently seen from Table 1, in the samples using combindly the metal complex and antioxidant according to the present invention, it is understood that the samples have good light-resistances, are less color fading due to heat and humudity and thus have large fastness of the dye image. This is an entirely unexpected effect for fastening the dye image against all of light, heat and humudity.

EXAMPLE 2

On a support consisting of a polyethylene-coated paper, the respective layers shown below were provided successively by coating to prepare a light-sensitive silver halide photographic material for multi-color.

First layer: blue-sensitive silver halide emulsion layer

A composition containing 8 mg/dm² of α-pivalyl-α-(1-benzyl-2,4-dioxo-imidazolidin-3-yl)-2-chloro-5-[γ-(2,4-di-t-amylphenoxy)butyramido]-acetanilide as the yellow coupler. 3mg/dm² as calculated on silver of a blue-sensitive silver chlorobromide emulsion, 3mg/dm² of 2,4-di-t-butylphenol-3',5'-di-t-amyl-4'-hydroxybenzoate, 3mg/dm² of dioctyl phthalate and 16 mg/dm² of gelatin was provided by coating.

Second layer: intermediate layer

Gelatin was provided by coating to a coating amount of 4 mg/dm².

Third layer: green-sensitive silver chlorobromide emulsion layer

A composition containing 4 mg/dm² of the above exemplary magenta coupler 36, 2 mg/dm² as calculated on silver of green-sensitive chlorobromide emulsion, 4 mg/dm² of dioctyl phthalate and 16 mg/dm² of gelatin was provided by coating.

Fourth layer: intermediate layer

A composition containing 3 mg/dm² of 2-hydroxy-3',5'-di-t-amylphenol)-benzotriazole and 3 mg/dm² of 2-(2'-hydroxy-3',5'-di-t-butylphenol)-benzotriazole as UV-absorbers, 4 mg/dm² of dioctyl phthalate and 14 mg/dm² of gelatin was provided by coating.

Fifth layer: red-sensitive silver chlorobromide emulsion layer

A composition containing 1 mg/dm² of 2,4-dichloro-3-methyl-6-[α-(2,4-di-t-amylphenoxy)butyramido]-phenol and 3 mg/dm² of 2-(2,3,4,5,6-pentafluorophenyl-)acylamino-4-chloro-5-[α-(2,4-di-tert-amylphenoxy)-pentylamide as cyan couplers, 2 mg/dm² of dioctyl phthalate, 3 mg/dm² as calculated on silver of a red-sensitive silver chlorobromide emulsion and 16 mg/dm² of gelatin was provided by coating.

Sixth layer: intermediate layer

A composition containing 2 mg/dm² of 2-(2'-hydroxy-3', 5'-di-t-amylphenol)-benzotriazole, 2 mg/dm² of 2-(2'-hydroxy-3',5'-di-t-butylphenol)-benzotriazole as UV-absorbers, 2 mg/dm² of dioctyl phthalate and 6 mg/dm² of gelatin was provided by coating.

Seventh layer: protective layer

Gelatin was provided to a coating amount of 9 mg/dm².

The sample thus prepared is called Sample 10 (Comparative).

Next, Samples 11 through 23 were prepared in the same manner as preparation of Sample 10 except for changing the combination of the metal complex, the antioxidant and the magenta coupler in the third layer of Sample 10 to those as indicated in Table 2.

For the samples thus prepared, the same exposure as in Example 1 was applied. However, optical wedge exposure was effected by use of green light in order to obtain a monochromatic sample of magenta. For each sample after exposure, light resistance and color fading due to heat and humidity of the magenta dye image were tested similarly as in Example 1.

Also for examination of the color purity of the magenta color formed sample, spectroscopic reflective density spectrum was measured in the following manner.

Measurement of Spectroscopic Reflective Density Spectrum of Magenta Color Formed Sample The spectroscopic refelection spectrum of the magenta color formed portion of each sample was measured by means of a color analyzer Model 607 (produced by Hitachi Co., Ltd.). In this measurement, the maximum density of the absorption spectrum at the visible region of each sample was normalized at 1.0.

The reflective density at 420 nm of each sample was defined as the side absorption density and used as a measure of color purity.

These results are shown in Table 2.

TABLE 2

| Sample No. | Magenta coupler | Metal complex | Anti-oxidant | Color fading [%] | Bluing degree | Redding degree | Side Absorption density |
|---|---|---|---|---|---|---|---|
| 10 (Comparative) | 36 | — | — | 94 | 157 | 103 | 0.20 |
| 11 (Comparative) | 36 | XI-4 (0.5) | — | 73 | 150 | 102 | 0.21 |
| 12 (Comparative) | 36 | XI-90 (0.5) | — | 70 | 151 | 101 | 0.21 |
| 13 (Comparative) | 36 | — | A-8 (0.5) | 82 | 140 | 103 | 0.20 |
| 14 (Comparative) | 36 | — | A-12 (0.5) | 84 | 138 | 102 | 0.20 |
| 15 (This invention) | 36 | XI-4 (0.5) | A-8 (0.5) | 39 | 120 | 101 | 0.21 |
| 16 (This invention) | 36 | XI-4 (0.5) | A-12 (0.5) | 41 | 118 | 100 | 0.21 |
| 17 (This invention) | 36 | XI-90 (0.5) | A-8 (0.5) | 45 | 111 | 100 | 0.21 |
| 18 (This invention) | 36 | XI-90 (0.5) | A-12 (0.5) | 46 | 115 | 102 | 0.21 |
| 19 (This invention) | 17 | XI-4 (0.5) | A-8 (0.5) | 28 | 102 | 105 | 0.21 |
| 20 (This invention) | 56 | XI-4 (0.5) | A-8 (0.5) | 30 | 103 | 107 | 0.21 |
| 21 (Comparative) | Comparative magenta coupler (0.5) | XI-4 (0.5) | A-8 | 84 | 121 | 172 | 0.37 |
| 22 (Comparative) | 36 | Comparative metal complex (0.5) | A-8 (0.5) | 81 | 151 | 103 | 0.20 |
| 23 (Comparative) | 36 | XI-4 (0.5) | Comparative anti-oxidant (0.5) | 70 | 154 | 104 | 0.21 |

The numerical values in the brackets indicate molar ratios relative to a mole of the coupler.

Comparative magenta coupler

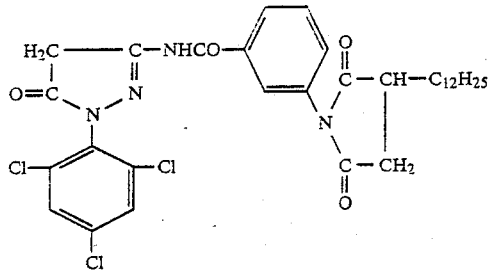

Comparative metal complex

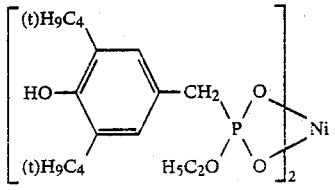

Comparative antioxidant

Ascorbic acid dilaurate

It can be seen from Table 2 that the combinations of the metal complex, the antioxidant and the magenta coupler according to the present invention are greater in the effect of improving both light resistance and color fading resistance due to heat and humidity.

In the samples of the present invention, the clear magenta images having less side absorption could be obtained.

Further, when any one of the comparative magenta coupler, the comparative metal complex or the comparative anti-oxidant was used, the above object cannot be accomplished sufficiently. It can be understood that only when the magenta coupler, the metal complex and the antioxidant of the present invention were combindly used, the dye images having less side-absorption and good light resistance and heat-and-humudity resistance can be obtained.

EXAMPLE 3

On a transparent support comprising a cellulose triacetate film subjected to subbing treatment having a halation preventive layer (containing 0.40 g of black colloid silver and 3.0 g of gelatin), the respective layers shown below were provided successively by coating to prepare Sample No. 27.

First layer: low sensitivity layer of red-sensitive silver halide emulsion layer A low sensitivity layer of a red-sensitive silver halide emulsion layer containing a dispersion of a solution of 1.8 g of a silver iodobromide emulsion (Emulsion I) color sensitized to red-sensitive, 0.8 g of 1-hydroxy-4-(β-methoxyethylaminocarbonylmethoxy)-N-[δ-(2,4-di-t-amylphenoxy)butyl]-2-naphthoamide (called D -1), 0.075 g of 1-hydroxy-4-[4-(1-hydroxy-8-acetamido-3,6-disulfo-2-naphthylazo)phenoxy]-N-[δ-(2,4-di-t-amylphenoxy)butyl]-2-naphthoamido.disodium (called CC-1), 0.015 g of 1-hydroxy-2-[δ-(2,4-di-t-amylphenoxy)-n-butyl]naphthoamide and 0.07 g of 4-octadecylsuccinimido-2-(1-phenyl-5-tetrazolylthio)-1-indanone (called D-1) dissolved in 0.65 g of tricresyl phosphate (called TCP) emulsified in an aqueous solution containing 1.85 g of gelatin.

Second layer: high sensitivity layer of red-sensitive silver halide emulsion layer A high sensitivity layer of a red-sensitive silver halide emulsion layer containing a dispersion of a solution of 1.2 g of a silver iodobromide emulsion (Emulsion II) color sensitized to red-sensitive, 0.21 g of the cyan coupler (C-1), 0.02 g of the colored cyan coupler (CC-1) dissolved in 0.23 g of TCP emulsified in an aqueous solution containing 1.2 g of gelatin.

Third layer: intermediate layer

An intermediate layer containing gelatin.

Fourth layer: low sensitivity layer of green-sensitive silver halide emulsion layer A low sensitivity layer of a green-sensitive silver halide emulsion containing a dispersion of 0.80 g of the Emulsion I color sensitized to green-sensitive and a dispersion emulsified 0.80 g of the exemplary compound 7 and 0.01 g of diethyllauric acid amide in an aqueous solution containing 2.2 g of gelatin.

Fifth layer: high sensitivity layer of green-sensitive silver halide emulsion layer A high sensitivity layer of a green-sensitive silver halide emulsion containing a dispersion of a solution of 1.8 g of the Emulsion II color sensitized to green-sensitive and a dispersion emulsified 0.20 g of the exemplary compound 7 dissolved in 0.25 g of diethyllauric acid amide in an aqueous solution containing 1.9 g of gelatin.

Sixth layer: yellow filter

A yellow filter layer containing 0.15 g of yellow colloid silver, a solution of 0.2 g of the color staining preventive (HQ-1) dissolved in 0.11 g of DBP and 1.5 g of gelatin.

Seventh layer: low sensitivity layer of blue-sensitive silver halide emulsion layer A low sensitivity layer of a blue-sensitive silver halide emulsion layer containing a dispersion of a solution of 0.2 g of the Emulsion I color sensitized to blue-sensitive and 1.5 g of a α-pivaloyl-α-(1-benzyl-2-phenyl-3,5-dioxyisoimidazolidin-4-yl)-2-chloro-5-[α-dodecyloxycarbonyl)ethoxycarbonyl]acetanilide (called Y -1 ) dissolved in 0.6 g of TCP emulsified in an aqueous solution containing 1.9 g of gelatin.

Eight layer: high sensitivity layer of blue-sensitive silver halide emulsion layer A high sensitivity layer of a blue-sensitive silver halide emulsion layer containing 0.9 g of an silver iodobromide emulsion sensitized to blue-sensitive and 1.30 g of the yellow coupler (Y-1) dissolved in 0.65 g of TCP emulsified in an aqueous solution containing 1.5 g of gelatin.

Ninth layer: protective layer

A protective layer containing 0.23 g of gelatin.

According to the same procedures as in the preparation of Sample 24, Samples No. 25 to No. 33 were prepared except that 40 mole % of the metal complex or the antioxidant was added to the coupler or a coupler was changed as shown in Table 3.

Each of Samples No. 24 to No. 33 was subjected to wedge exposure by use of green light, followed by the developing processing shown below.

| Developing processings | | |
|---|---|---|
| Color developing solution | 38° C. | 3 min. 15 sec. |
| Bleaching solution | 38° C. | 4 min. 20 sec. |
| Water washing | 38° C. | 3 min. 15 sec. |
| Fixing solution | 38° C. | 4 min. 20 sec. |
| Water washing | 38° C. | 3 min. 15 sec. |
| Stabilizing solution | 38° C. | 1 min. 30 sec. |

-continued

| | |
|---|---|
| Drying | 47° C. ± 5° C. 16 min. 30 sec. |

The composition of the used color developing solution is as follows:

| | |
|---|---|
| Potassium carbonate | 30 g |
| Sodium hydrogen carbonate | 2.5 g |
| Potassium sulfite | 5 g |
| Sodium bromide | 1.3 g |
| Potassium iodide | 2 mg |
| Hydroxylamine sulfate | 2.5 g |
| Sodium chloride | 0.6 g |
| Sodium diethylenetriaminetetraacetate | 2.5 g |
| 4-Amino-3-methyl-N—ethyl-N—(β-hydroxyethyl)aniline sulfate | 4.8 g |
| Potassium hydroxide | 1.2 g |
| (made up to one liter with addition of water, and adjusted to pH 10.06 with potassium hydroxide or 20% sulfuric acid). | |

Further, the composition of the used bleaching solution is as follows:

| | |
|---|---|
| Ammonium ethylenediaminetetraacetate | 100 g |
| Ethylenediaminetetraacetic acid | 10 g |
| Ammonium bromide | 150 g |
| Glacial acetic acid | 40 ml |
| Sodium bromate | 10 g |
| (made up to one liter with addition of water, and adjusted to pH 3.5 with ammonia water or glacial acetic acid). | |

The composition of the used fixing solution is as follows:

| | |
|---|---|
| Ammonium thiosulfate | 180 g |
| Anhydrous sodium sulfite | 12 g |
| Sodium metabisulfite | 2.5 g |
| Disodium ethylenediaminetetraacetate | 0.5 g |
| Sodium carbonate | 10 g |
| (made up to one liter with addition of water). | |

The composition of the used stabilizing solution is as follows:

| | |
|---|---|
| Formalin (37% aqueous solution) | 2 ml |
| Konidax (produced by Konishiroku Photo Industry Co., Ltd.) | 5 ml |
| (made up to one liter with addition of water). | |

Light-resistance and changes due to heat and humidity of the samples as prepared above were examined in the same manner as in Example 1.

The results are shown in Table 3.

TABLE 3

| Sample No. | Magenta coupler | Metal complex | Anti-oxidant | Color fading [%] | Bluing degree | Redding degree |
|---|---|---|---|---|---|---|
| 24 (Comparative) | 7 | — | — | 97 | 159 | 102 |
| 25 (Comparative) | 7 | XI-4 | — | 86 | 151 | 103 |
| 26 (Comparative) | 7 | — | A-8 | 89 | 143 | 102 |
| 27 (This invention) | 7 | XI-4 | A-8 | 47 | 119 | 103 |
| 28 (This invention) | 36 | XI-4 | A-8 | 45 | 118 | 101 |
| 29 (This invention) | 7 | XI-4 | A-8 | 28 | 107 | 103 |
| 30 (This invention) | 56 | XI-4 | A-8 | 33 | 115 | 100 |
| 31 (This invention) | 74 | XI-4 | A-8 | 27 | 112 | 101 |
| 32 (Comparative) | 7 | Comparative complex | A-8 | 83 | 135 | 103 |
| 33 (Comparative) | 7 | XI-4 | Comparative antioxidant | 85 | 144 | 104 |

The comparative complex and the comparative antioxidant are the same as used in Example 2.

As can be clearly seen from Table 3, in the system where the metal complex and the antioxidant according to the present invention were combindly used, not only great preventive effect against light fading but also less change due to heat and humidity can be obtained.

Further, in the samples of the present invention, clear color image can be obtained without affecting to the photographic performances such as sensitivity, gradation, etc.

Light resistance and fastness to heat and humidity of the magenta coupler according to the present invention, which is good in color purity and useful as the diequivalent coupler could be further improved due to synergistic effect to a great extent by combining it with the metal complex and the antioxidant according to the present invention.

We claim:

1. A light-sensitive silver halide photographic material, which comprises a magenta coupler represented by formula (II) or (III) shown below; a compound represented by the formula (XI) shown below; and further at least one compound selected from the group consisting of the compounds represented by the formulae (XII), (XIII) and (XIV) shown below:

(XI)

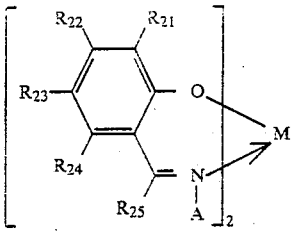

wherein $R_{21}$, $R_{22}$, $R_{23}$ and $R_{24}$ each represent a hydrogen atom, a halogen atom, a hydroxy group, a cyano group, or an alkyl group, an aryl group, a cycloalkyl group or a heterocyclic group each of which are bonded to carbon atom directly or via a divalent linking group, and from $R_{21}$ and $R_{22}$, $R_{22}$ and $R_{23}'$ or $R_{23}$ and $R_{24}$ may be formed a 6-membered ring by linking with each other; $R_{25}$ represents a hydrogen atom, an alkyl group or an aryl group; A represents a hydrogen atom, an alkyl group, an aryl group or a hydroxy group; and M represents a metal atom.

(XII)

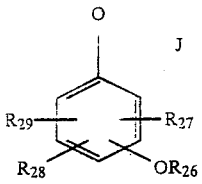

(XIII)

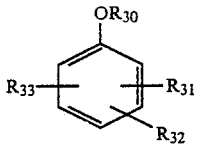

(XIV)

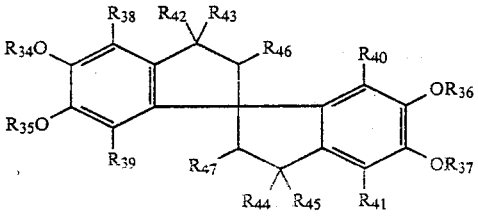

wherein $R_{26}$ and $R_{30}$ each represent a hydrogen atom, an alkyl group, an acyl group, a sulfonyl group, a carbamoyl group, a sulfamoyl group, an alkoxycarbonyl group or a trialkylsilyl group: J represents a group of non-metallic atoms necessary for forming a 5- or 6-membered ring with a carbon atom or an oxygen atom to be bonded and each of 5- or 6-membered ring may have a bis-spiro bond: $R_{27}$, $R_{28}$ and $R_{29}$ each represent a hydrogen atom, an alkyl group, an alkoxy group, an aryl group, an aryloxy group, an alkenyl group, an alkenoxy group, an acylamino group, a diacylamino group, a halogen atom, an alkylthio group, an arylthio group, an alkoxycarbonyl group, an acyloxy group, an acyl group or a sulfonamide group; $R_{31}$, $R_{32}$ and $R_{33}$ each represent a hydrogen atom, a hydroxyl group, an alkyl group, an alkenyl group, an alkoxy group, an aryl group, an aryloxy group, an acyloxy group, an alkoxycarbonyl group, an alkylthio group or an arylthio group, provided that the total carbon numbers of $R_{31}$, $R_{32}$ and $R_{33}$ are 8 or more; $R_{34}$, $R_{35}$, $R_{36}$ and $R_{37}$ each represent a hydrogen atom, an alkyl group, an alkenyl group, an aryl group, a heterocyclic group, a $R_{48}$—CO— group, a $R_{49}$—$SO_2$— group or a $R_{50}$—NHCO— group where $R_{48}$, $R_{49}$ and $R_{50}$ each represent an alkyl group, an alkenyl group, an aryl group or a heterocyclic group; $R_{38}$, $R_{39}$, $R_{40}$ and $R_{41}$ each represent a hydrogen atom, a halogen atom, an alkyl group, an alkenyl group, an alkoxy group or an alkenoxy group; and $R_{42}$, $R_{43}$, $R_{44}$, $R_{45}$, $R_{46}$ and $R_{47}$ each represent a hydrogen atom, an alkyl group, an alkenyl group or an aryl group Compounds of formula (II) and (III)

(II)

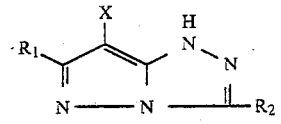

(III)

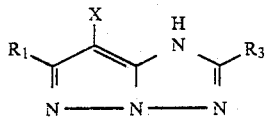

wherein X is hydrogen or a substituent eliminable through the reaction with an oxidized product of a color developing agent; $R_1$ is a secondary or tertiary alkyl having the formula (IX):

(IX)

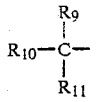

wherein $R_9$, $R_{10}$ and $R_{11}$ are each alkyl groups or one of $R_9$, $R_{10}$ and $R_{11}$ represents a hydrogen atom and the remainder are alkyl groups or are bonded together to form a cycloalkyl group and $R_2$ and $R_3$ are hydrogen or said secondary or tertiary alkyl having the formula (IX).

2. A light-sensitive silver halide photographic material according to claim 1, wherein M or the metal complex represented by the formula (XI) is nickel atom.

3. A light-sensitive silver halide photographic material according to claim 1, wherein the compound represented by the formula (XII) is a compound represented by the formula (XII'):

(XII')

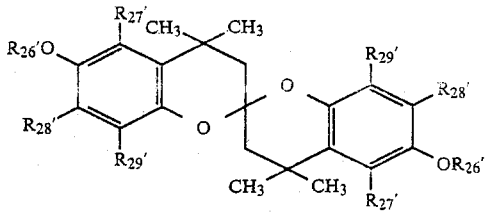

wherein $R_{26}'$, $R_{27}'$, $R_{28}'$ and $R_{29}'$ have the same meanings as $R_{26}$, $R_{27}$, $R_{28}$ and $R_{29}$ in the formula (XII), respectively.

4. A light-sensitive silver halide photographic material according to claim 1, wherein the compound represented by the formula (XII) is 5-hydroxycoumarans, 6-hydroxychromans or 6,6'-hydroxy-bis-2,2'-spirochromans.

5. A light-sensitive silver halide photographic material according to claim 1, wherein the compound represented by the formula (XIII) is a compound represented by the formula (XIII'):

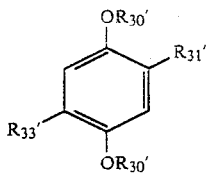

(XIII')

wherein $R_{30}'$, $R_{30}''$, $R_{31}'$ and $R_{33}'$ have the same meanings as $R_{30}$, $R_{31}$ and $R_{33}$ in the formula (XIII).

6. A light-sensitive silver halide photographic material according to claim 1, wherein the compound represented by the formula (XIV) is a compound shown below:

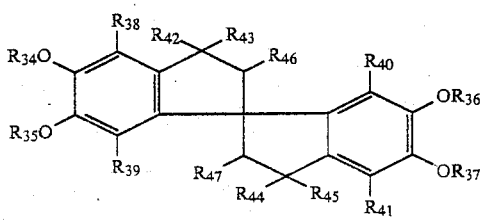

(XIV)

wherein $R_{34}$, $R_{35}$, $R_{36}$ and $R_{37}$ each represent a hydrogen atom, a methyl group, an ethyl group, a propyl group, an n-octyl group, an i-octyl group, an allyl group, an octenyl group, an oleyl group, a phenyl group, a tetrahydropyranyl group, a pyrimidyl group, a $R_{48}$—CO— group, a $R_{49}$—$SO_2$— group or a $R_{50}$—NH-CO— group, where, $R_{R48}$, $R_{49}$ and $R_{50}$ each represent a methyl group, an ethyl group, an n-propyl group, an n-butyl group, an n-octyl group, a benzyl group, an allylōctenyl group, an oleyl group, a phenyl group, a methoxyphenyl group, a naphthyl group, a pyridyl group or a pyrimidyl group; $R_{38}$, $R_{39}$, $R_{40}$ and $R_{41}$ each represent a hydrogen atom, a chlorine atom, a bromine atom, a methyl group, an ethyl group, an n-butyl group, an n-octyl group, a hexenyl group, an octenyl group, an allyl group, a methoxy group, an ethoxy group, a benzyloxy group or a hexenyloxy group, and these groups represented by the $R_{38}$, $R_{39}$, $R_{40}$ and $R_{41}$ may be the same or different from each other; and $R_{42}$, $R_{43}$, $R_{44}$, $R_{45}$, $R_{46}$ and $R_{47}$ each represent a hydrogen atom, a methyl group, an ethyl group, an n-propyl group, an n-butyl group, a benzyl group, a hexenyl group, an octenyl group, a phenyl group or a naphthyl group, an these groups represented by the $R_{42}$, $R_{43}$, $R_{44}$, $R_{45}$, $R_{46}$ and $R_{47}$ may be the same of different from each other.

7. A light-sensitive silver halide photographic material according to claim 1, wherein the magenta coupler represented by the formula (I), a compound represented by the formula (XI) and a compound represented by the formula (XII), (XIII) or (XIV) are contained with a high boiling point solvent having a dielectric constant of 7.5 or less and 1.9 or more and a vapor pressure of 0.5 mmHg or lower at 100° C.

8. A light-sensitive silver halide photographic material according to claim 1, wherein an amount of the metal complex represented by the formula (XI) is 0.05 to 0.5 mole per mole of the coupler.

9. A light-sensitive silver halide photographic material according to claim 1, wherein an amount of the compound represented by the formula (XII), (XIII) or (XIV) is 0.1 to 0.4 mole per mole of the coupler.

10. The light-sensitive silver halide material of claim 1 wherein $R_2$ is said secondary or tertiary alkyl.

11. The light-sensitive silver halide material of claim 1 wherein $R_2$ is hydrogen.

12. The light-sensitive silver halide photographic material according to claim 1 wherein the magenta coupler is a compound of formula II.

13. The light-sensitive silver halide photographic material according to claim 1 wherein the magenta coupler is a compound of formula III.

14. The light-sensitive silver halide material of claim 1 wherein $R_3$ is said secondary or tertiary alkyl.

15. The light-sensitive silver halide material of claim 1 wherein $R_3$ is hydrogen.

* * * * *